US006774848B2

(12) United States Patent
Wright

(10) Patent No.: US 6,774,848 B2
(45) Date of Patent: Aug. 10, 2004

(54) CONFORMAL PHASED ARRAY ANTENNA

(75) Inventor: Peter John Wright, Salisbury (GB)

(73) Assignee: Roke Manor Research Limited, Romsey (GB)

( * ) Notice: Subject to any disclaimer, the term of this patent is extended or adjusted under 35 U.S.C. 154(b) by 0 days.

(21) Appl. No.: 10/180,985

(22) Filed: Jun. 27, 2002

(65) Prior Publication Data

US 2003/0020666 A1 Jan. 30, 2003

(30) Foreign Application Priority Data

Jun. 29, 2001 (GB) ..... 0115892
Feb. 27, 2002 (GB) ..... 0204582

(51) Int. Cl.[7] ..... H01Q 1/38
(52) U.S. Cl. ..... 343/700 MS; 343/705; 343/824
(58) Field of Search ..... 343/700 MS, 705, 343/708, 713, 824, 853

(56) References Cited

U.S. PATENT DOCUMENTS 3,699,574 A * 10/1972 O'Hara et al. ..... 343/705
4,110,751 A * 8/1978 Reggia et al. ..... 343/700 MS
4,912,477 A 3/1990 Lory et al. ..... 342/373
5,160,936 A 11/1992 Braun et al. ..... 343/725
5,463,656 A 10/1995 Polivka et al. ..... 375/200
5,642,122 A * 6/1997 Lockie et al. ..... 343/881
5,861,840 A 1/1999 Tarran et al. ..... 342/371
5,977,918 A 11/1999 Sirmalis ..... 343/709
6,166,705 A * 12/2000 Mast et al. ..... 343/853

FOREIGN PATENT DOCUMENTS

EP 0767511 4/1997

* cited by examiner

*Primary Examiner*—Hoang V. Nguyen
(74) *Attorney, Agent, or Firm*—Crowell & Moring LLP

(57) ABSTRACT

The present invention provides an antenna assembly (10) comprising a plurality of planar tiles (20). Each of the tiles carries a planar array of sets (22) of antenna elements (47–50) arranged to be operated as a phased array antenna. The tiles are arranged in an orientation which is conformal to a contour of an underlying structure. In use, only those tiles which are capable of communication in the steered direction are enabled, while those which are not capable of communicating in the steered direction are not used.

16 Claims, 20 Drawing Sheets

CONFORMAL PHASED ARRAY ANTENNA

Phased array antennae are well known in the field of radio and microwave communication. They comprise a plurality of antenna elements spaced apart from each other by known distances. By applying a calculated phase shift to signals received or transmitted from each element, the antenna may effectively be steered—that is, given a high gain in a certain direction. A phased array antenna typically comprises a planar array of elements, and the direction of maximum gain may typically be steered in two directions, which may be referred to as "azimuth" and "elevation" for convenience. The maximum gain direction, or "beam" may be steered within a particular angular range, dependent on the construction of the phased array. Typically, the range allows for the beam to be steered to any direction within 60° of the normal to the plane of the array.

Such antennae find application in the fields of satellite communication, mobile telephony and microwave communication.

In a particular embodiment, the present invention provides a novel configuration of a phased array antenna for mobile satellite communications from an airborne platform.

Such antennae have limited angular range, as discussed above, and some attempts have been made to overcome this limitation. For example, it is desired to be able to send and receive communications to/from a particular satellite without having to realign the phased array antenna each time that a new satellite is to be communicated with. Similarly, if the phased array antenna is to be mounted on a moveable vehicle, one does not want to have to realign the antenna every time a transmission or reception is to take place.

U.S. Pat. No. 5,861,840 and European Patent Application 0 767 511, each incorporated herein by reference, each describe an antenna array for providing wide angle coverage, using a number of planar phased arrays. In an example described in these documents, triangular planar arrays of dipole antennae are formed using a method similar to printed circuit board manufacture. Thirty triangular arrays are assembled into a polyhedron providing substantially hemispherical coverage. Each planar array is capable of being steered so as to transmit and/or receive signals within an angular range of up to about 60° from the normal. The invention described in U.S. Pat. No. 5,861,840 and European Patent Application 0 767 511 is based on placing a number of such planar arrays in mutual proximity, angled to each other at angles of less than about 60°. By providing enough planar arrays, one may be sure that at least one of the planar arrays will be capable of satisfactorily receiving and/or transmitting in a required direction.

While U.S. Pat. No. 5,861,840 and European Patent Application 0 767 511 provide an antenna composed of a number of component planar arrays arranged in an approximate hemisphere, or other polyhedron determined by the required coverage, such antenna assemblies may be impractical in certain situations. For example, while it may be possible to mount a hemispherical or even spherical antenna assembly on a mast carried by a land vehicle or water-borne vessel, it may be impractical to mount such a mast, or indeed such an antenna array, on a high-speed vehicle such as an aircraft.

The present invention therefore aims to provide a relatively omnidirectional phased array antenna which is conformal, that is, may be adapted to be mounted on a carrying vehicle without substantially negatively influencing the aerodynamics or aesthetics of the contour of the vehicle. The present invention applies particularly to aircraft, since issues of aerodynamics are of great importance. Furthermore, the aircraft, and hence any attached antenna array, may change its orientation with respect of the source or destination of the radio signal, in roll, pitch and yaw. It is important that the antenna array can remain in communication with the radio source/destination despite such movement of the antenna.

Although suitable for mounting on an aircraft, the antenna array of the present invention may find application to other vehicles, such as water-borne craft, which may also move in roll, pitch and yaw, although to a lesser extent than aircraft, and to land vehicles which move principally only in yaw (azimuth), but may need hemispherical coverage to remain in communication with one or more communications satellites at certain elevation angles, while the vehicle moves in azimuth.

Accordingly, the invention provides apparatus and methods as defined in the appended claims.

In particular, the present invention provides an antenna assembly comprising a plurality of planar tiles. Each of the tiles carries a planar array of sets of antenna elements arranged to be operated as a phased array antenna, the tiles being arranged in an orientation which is conformal to a contour of an underlying structure.

The underlying structure may be a part of a vehicle carrying the antenna structure, such as a part of the fuselage of an aircraft or a part of a superstructure of an aircraft. The underlying structure may alternatively be a part of a land vehicle or a water-borne vehicle.

In a certain embodiment, the tiles are arranged in a first arc about an axis. The tiles are then each arranged in a plane tangent to the arc. Preferably, the planes of the tiles are parallel to the axis. A further arc of tiles may also be provided about the axis, each tile of the further arc being tilted with respect to the adjacent tile of the first arc, towards the axis. In a certain embodiment, a further arc of tiles about the axis, is provided on each side if the first arc of tiles, each tile of each further arc being tilted with respect to the adjacent tile of the first arc, towards the axis.

Preferably, in such embodiments, the angle of the tilt is sufficient to enable the antenna array to be sensitive in the direction of the axis. The angle of the tilt is preferably at least approximately 30°.

Each tile may comprise control circuitry for controlling phase shifts in signals applied to, or received from, each set of antenna elements.

The present invention also provides a method of communication, comprising the steps of:

- providing an antenna assembly as described;
- calculating a direction of required transmission/reception with respect to the antenna assembly;
- calculating which of the tiles are capable of transmitting or receiving in the required direction;
- enabling the capable tiles and disabling the remaining tiles;
- steering the antenna elements of the enabled tiles in the required direction; and
- using the enabled tiles of the antenna array for transmission and/or reception of required signals.

The above, and further, objects, advantages and characteristics of the present invention will become more apparent by reference to the following description of certain embodiments thereof, with reference to the appended drawings, wherein:

FIG. 1 shows an embodiment of an antenna assembly according to the present invention;

FIG. 2 schematically shows a layout of antenna elements on a tile suitable for use in an antenna assembly of the present invention;

FIGS. 8A–13A show the selection of tiles of an antenna of an embodiment of the present invention used to transmit or receive in certain selected directions;

FIGS. 8B–13C show examples of sensitivity of the antenna of an embodiment of the present invention in the respective directions shown in FIGS. 8A–13A;

Figure 1:
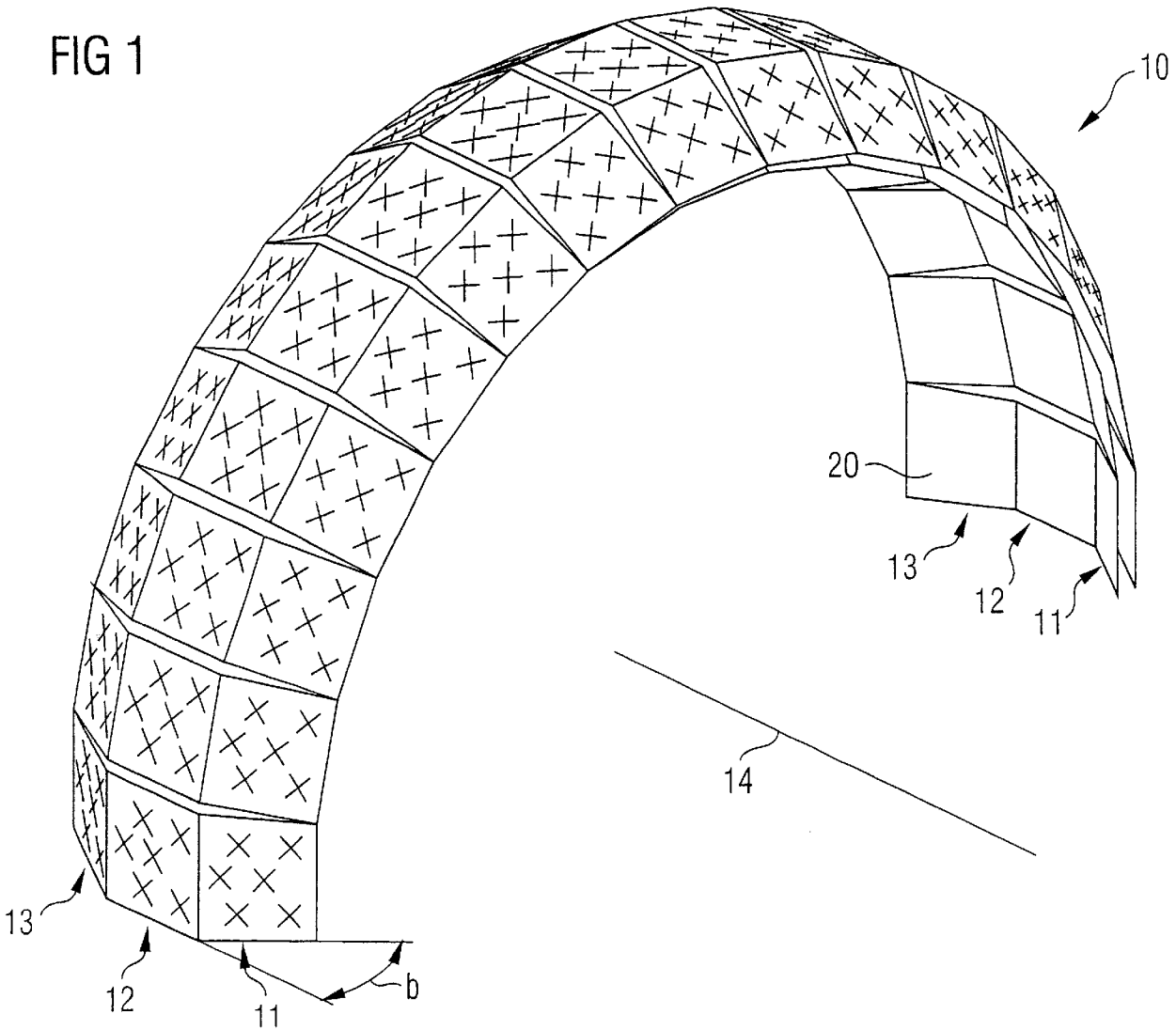

FIG. 1 shows a phased array antenna according to an embodiment of the present invention. The antenna 10 is of a substantially arcuate shape, being composed of three rows 11, 12, 13 of tiles 20. Each row of tiles itself forms an arc, and the three arcs are contiguously located. The central arc 12 is composed of tiles having their plane arranged parallel to an axis 14 of the arc. The arcs 11, 13 on either side of the central arc 12 each have their tiles inclined at an angle b, tilted from the adjacent tile of the central arc 12 towards the axis 14 of the arc. While the embodiment illustrated in FIG. 1 shows an arc with an included angle of approximately 180°, other arcs may of course be used. Indeed, many orientations of tiles other than arcs may be used.

The antenna of FIG. 1 is designed to provide full hemispherical coverage and preferably provides full duplex communication.

In use, the antenna of the present invention is preferably covered with a protective cover, which may also function to improve the aerodynamics and aesthetics of the antenna.

Figure 2:
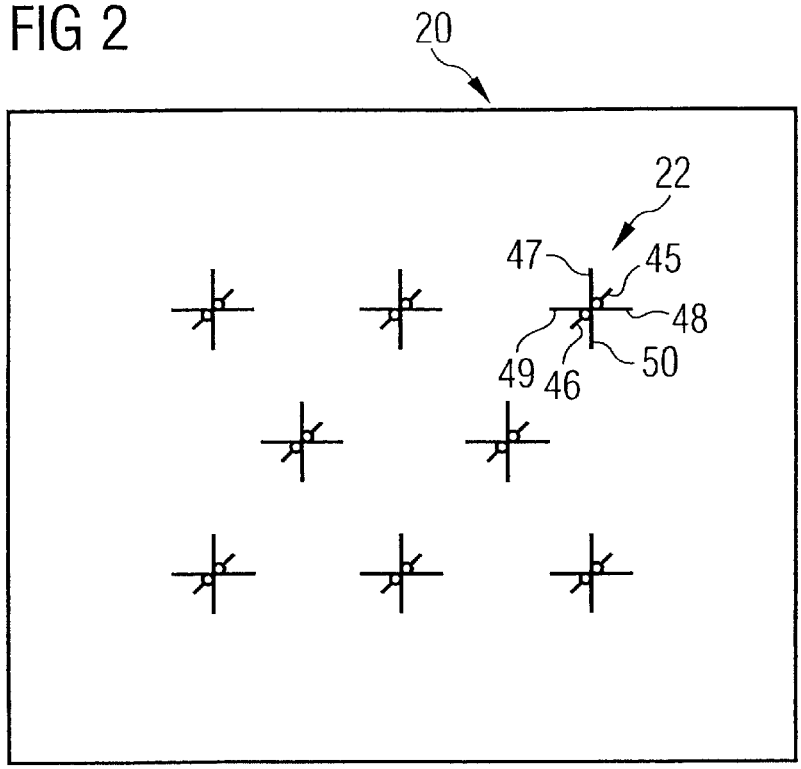

Each tile of the antenna comprises a planar array of antennae. Preferably, six or eight crossed dipole antennae are provided, together with associated transmit, receive and beam-steering circuitry, on each tile. FIG. 2 schematically represents a tile 20 of the antenna of the present invention. The tile comprises a number of antenna pairs 22, each comprising a first dipole 48, 49 and a second dipole 47, 50. Each of the dipoles may act as a transmitter or as a receiver. The crossed arrangement shown in FIG. 2 is preferably used, since that provides the required circular polarisation for communication with satellites. Feeders 45, 46, such as coaxial feeders, may be provided to conduct signals to and from the antenna pairs 22. The feeders may be unbalanced, in which case a balancing stub may be applied to selected arms 47–50 of the antenna pair to maintain symmetry.

The antenna of the present invention is preferably composed of a number of identical planar tiles, enabling a relatively simple manufacturing process for the tiles.

Figure 3:
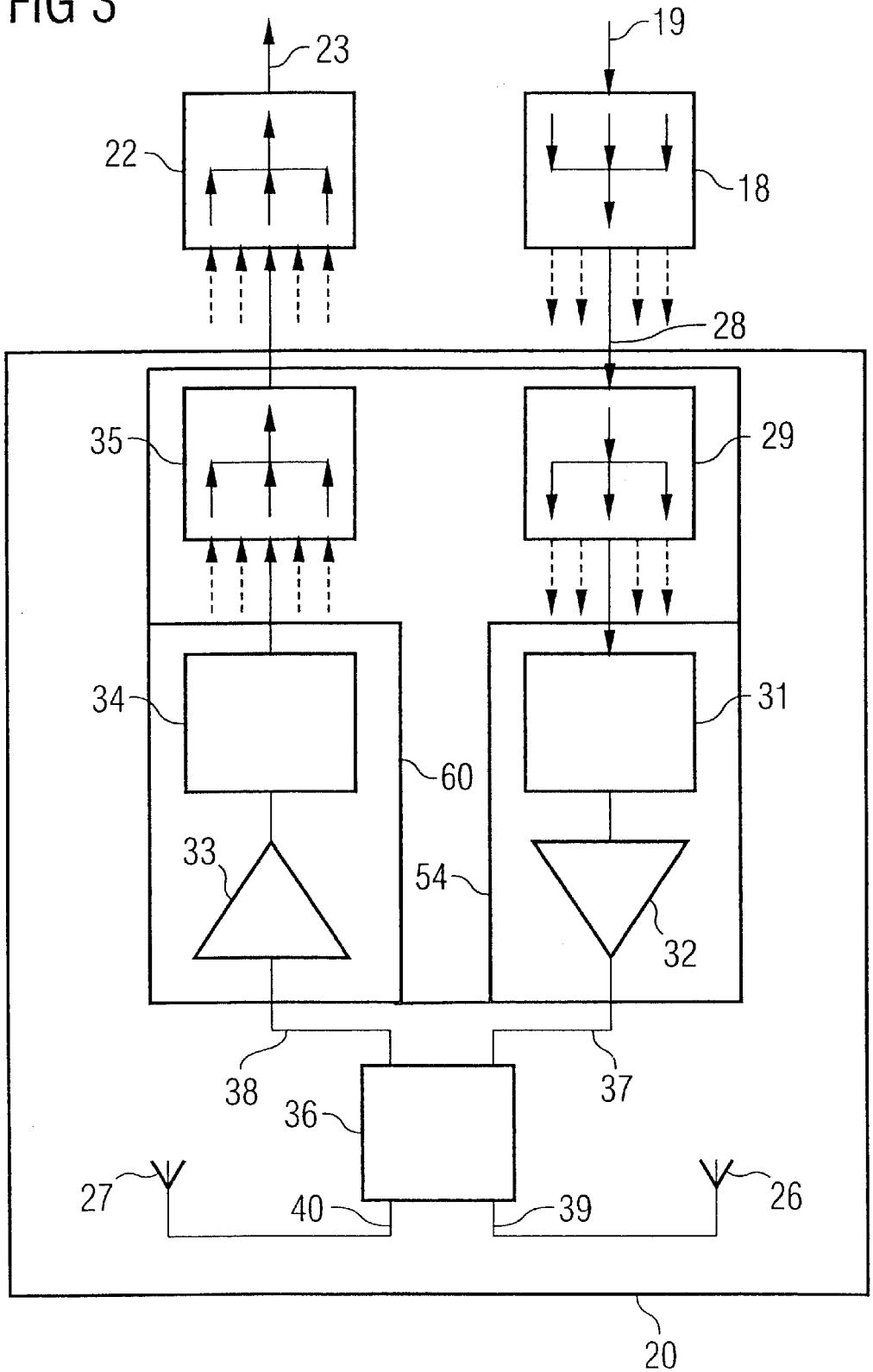
FIG. 3 shows a schematic circuit diagram of control circuitry which may be used to provide signals to, and receive signals from, tiles of the antenna of the present invention.

FIG. 3 shows a circuit block diagram, which illustrates functional units used in the transmission and reception of radio signals by the antenna system 10. A primary splitter 18 splits the signal to be transmitted between the various tiles 20. Only the functional units associated with a single antenna pair 26, 27, of a single antenna unit 20 are shown for the sake of clarity. A subdivided radio signal enters the tile 20, from the primary splitter 18 via a conductor 28, which conveys the signal to be transmitted to a secondary splitter 29. Also shown in FIG. 3 are the transmit phase shifter 31 and power amplifier 32 which may be embodied as a transmit microwave integrated circuit 54 (MIC).

Additionally, a low noise amplifier 33 and a receive phase shifter 34 are provided, and these may similarly be embodied as a receive MIC. Also, the figure illustrates secondary combiner 35, and a branch line coupler 36. The branch line coupler 36 is fed with the signal to be transmitted by a conductor 37. The branch line coupler 36 feeds a received signal to the low noise amplifier 33 via conductor 38. The branch line coupler 36 is also connected to the antenna pair 26, 27 via conductors 39 and 40. A primary combiner 22 is also shown, which has a function opposite to that of the primary splitter 18.

Figure 4:
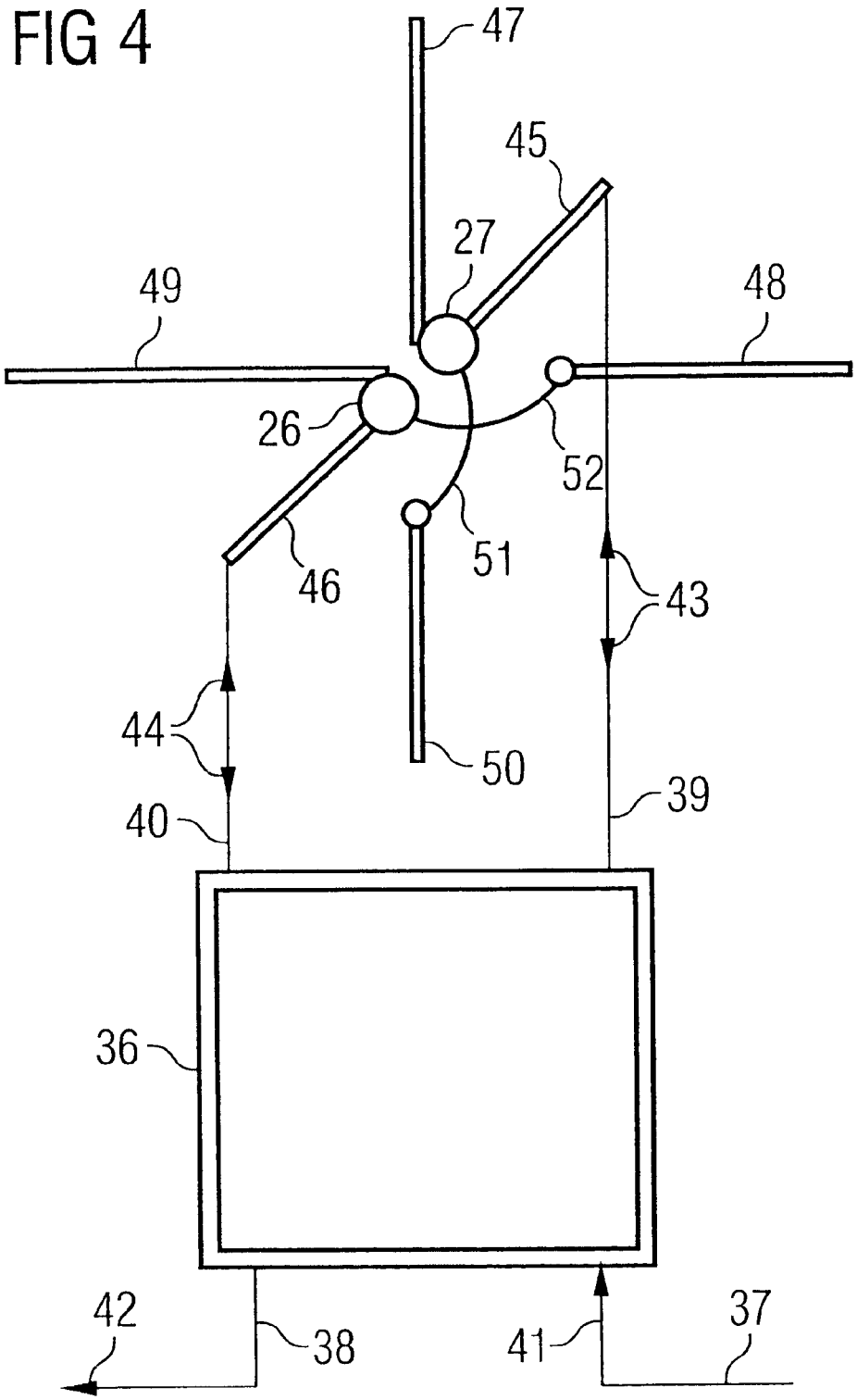
FIG. 4 shows a portion of FIG. 3 in more detail.

An example of an embodiment of an antenna pair 26, 27 is shown in FIG. 4. In FIG. 4, the construction of the antenna pair 26, 27 is shown connected to the branch line coupler 36, via conductors 39, 40.

A signal to be transmitted is fed to the branch line coupler 36, via the conductor 37 as indicated by the arrow 41. Similarly, the received signal is fed from the branch line coupler 36 as indicated by the arrow 42. The branch line coupler 36 operates to circularly polarise both the signal to be transmitted and the received signal but in opposite directions. The signal to be transmitted is fed to the antenna pair 26, 27 via the conductors 39, 40 and the received signal is fed from the antenna pair 26, 27 via the connectors 39, 40 as indicated by the arrows 43, 44.

The antenna pair 26, 27 is embodied as first and second dipoles 26, 27 and further comprises first and second feeders 45, 46 which may be coaxial feeders. The dipoles 26, 27 each comprise two arms, 48, 49; 47 and 50, which are fabricated so that they are offset from each other by an angle of 90°. The polarised signals are conveyed to and from the dipoles 26, 27 via the feeders 45, 46. The unbalanced co-axial feeders 45, 46 may be used with balancing stubs connected to arms 50, 48 to preserve the symmetry of the radiation patterns. The transmitted and received signals are oppositely polarised by virtue of the phase displacement introduced by the branch line coupler 36.

Figure 5:
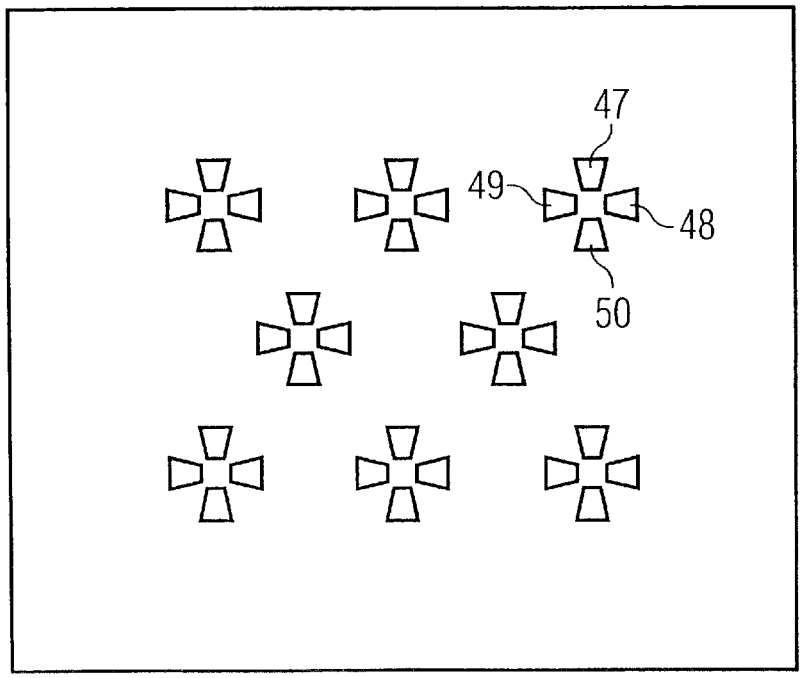
FIG. 5 shows an example of the layout of antenna elements on a tile suitable for use in an antenna assembly of the present invention.

FIG. 5 shows a possible layout of the antenna pairs of the tile 20, in that each arm 47–50 is embodied as a truncated triangle, forming an arm of a right cross, truncated apexes of the arms being directed to the centre of the cross. Such antenna arms may be embodied as foil patterns in a layer (preferably the uppermost layer) of a printed circuit board.

Construction and operation of the tiles 20 of the antenna of the present invention may be identical to that disclosed in U.S. Pat. No. 5,861,840 and European Patent Application 0 767 511, and the reader's attention is directed to those documents. Further discussion of possible embodiments of the tiles appears below.

However, antennae according to the present invention may operate and be constructed according to other methods. The tiles 20 may be rectangular, square, triangular, or of any shape which suit the purpose of providing an array of planar tiles each carrying an array of phased antennae, in an orientation which is substantially conformal to the contours of a vehicle or other structure upon which the antenna of the present invention is mounted.

Figure 6:
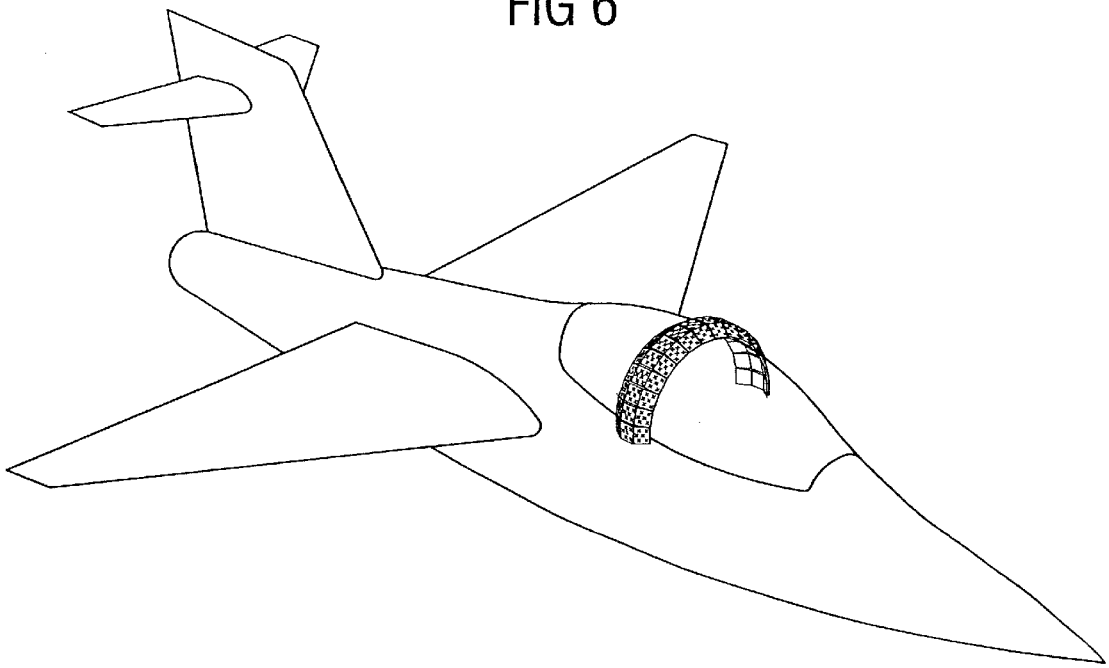
FIG. 6 shows an example of an antenna assembly according to the present invention, mounted on the superstructure of an aircraft.
Figure 7:
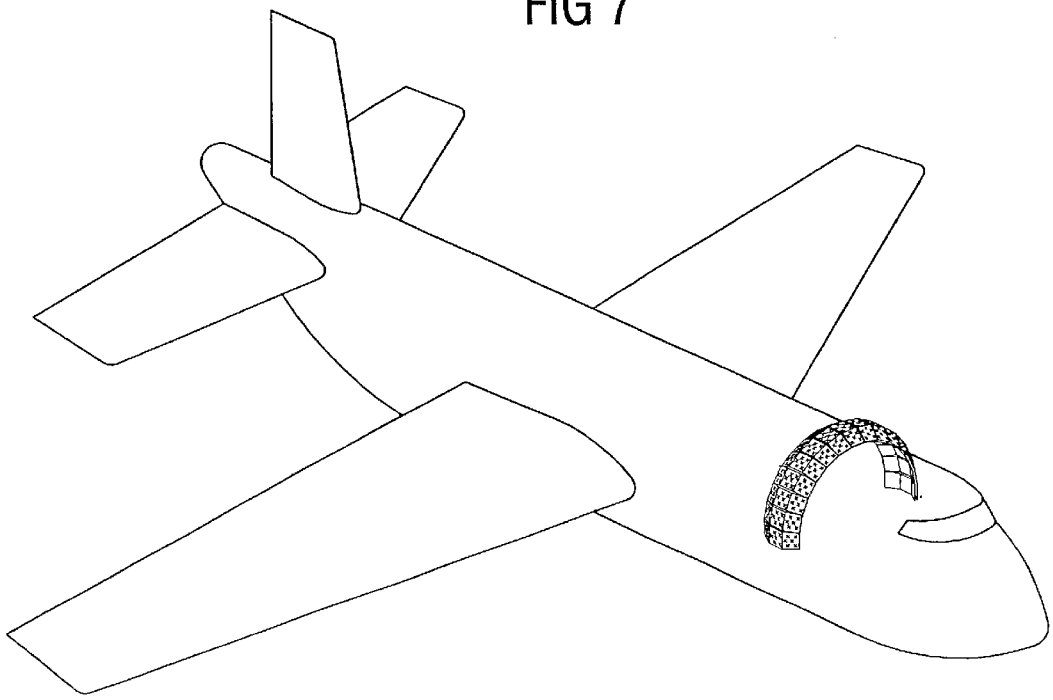
FIG. 7 shows an example of an antenna assembly according to the present invention, mounted on the fuselage of an aircraft.

The arcuate structure of FIG. 1 is particularly adapted for installation on aircraft. As illustrated in FIG. 6, the antenna may be located around a cockpit or a superstructure of an aircraft. Alternatively, as illustrated in FIG. 7, the antenna may be placed around the fuselage of the aircraft. Although illustrated in FIGS. 6 and 7 as extending only around the upper portion of the aircraft, the antenna may be placed around the lower portion of the aircraft, or even completely encircling the body of the aircraft. The antenna may extend through an arc of included angle of approximately 180°, as illustrated, or through an arc of greater or lesser included angle. The choice of included angle and location of the antenna may depend on many factors, for example, whether the source/destination of the received/transmitted signals normally lies above the aircraft, such as for satellite communications, or below the aircraft, such as for terrestrial radio transmitters/receivers. If the aircraft is likely to make extreme changes of orientation, for example, loops, it may be preferred to install the antenna of the present invention such that it completely encircles the aircraft. Alternatively, the antenna may not be continuous around the aircraft, but may be located in discrete segments. Such segments may be placed in mutually axially displaced locations.

While one may seek to flatten the antenna as much as possible against the existing surface of the aircraft or other carrying vehicle, the antenna must not be flattened too much, otherwise the antenna will become insensitive in the forward and aft directions (e.g. along the axis 14). In some embodiments, the antenna may not need to be sensitive in the forward and aft directions, in which case the antenna may be further flattened against the existing surface of the vehicle, improving aerodynamics. For example, if only radial sensitivity were required, only the central arc 12 could be provided.

FIGS. 8–13 illustrate certain aspects of the operation of the antenna according to the invention as illustrated in FIG. 1 in certain operating conditions. In the discussion of FIGS. 8–13, the antenna will be assumed to remain in a stationary position about a stationary horizontal axis. The term Azimuth will be used in relation to angles in the plane containing the axis and parallel to a line joining opposite ends of the arc. An azimuthal angle of 0° indicates the direction of the axis. Elevation will be used to indicate angles measured at the intersection of the plane containing the arc, and the axis, with reference to the plane containing the axis and parallel to a line joining opposite ends of the arc.

Figure 8A:
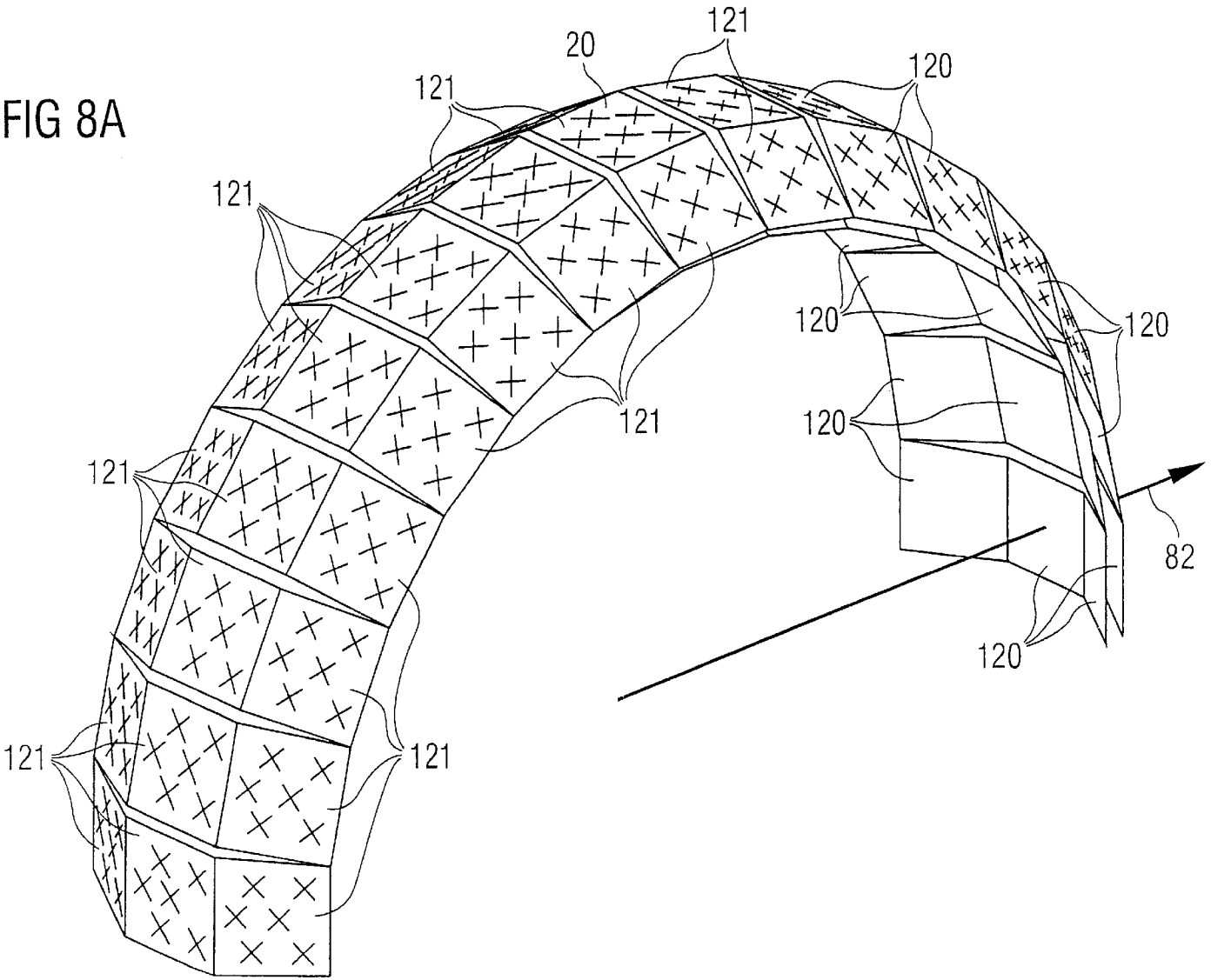

In FIG. 8A, the antenna A receives and/or transmits a signal from/to the direction 82. This direction corresponds to Az (azimuth)=90°; El (elevation)=0°. All of the antenna tiles 20 which are capable of transmitting/receiving in the direction 82 are enabled, and are individually tuned to be transmissive/receptive in the direction 82. Typically, a planar phased array antenna may have its transmission and/or reception sensitivity "beam-steered" in any direction of up to 60° from the normal. In the example shown in FIG. 8A, all tiles within an arc corresponding to an elevation angle of EL=−60° to 60° are enabled and appropriately beam-steered. These tiles are labelled 120 in FIG. 8A. Since the entire arc encompasses approximately 180°, approximately one third 120 of the tiles are used in FIG. 8A. The remaining tiles 121 are inactive. They are prevented from transmitting or receiving signals, because any signals they could receive will be noise, not from the intended source, and any signals they could transmit would not reach their intended destination.

Figure 8B:
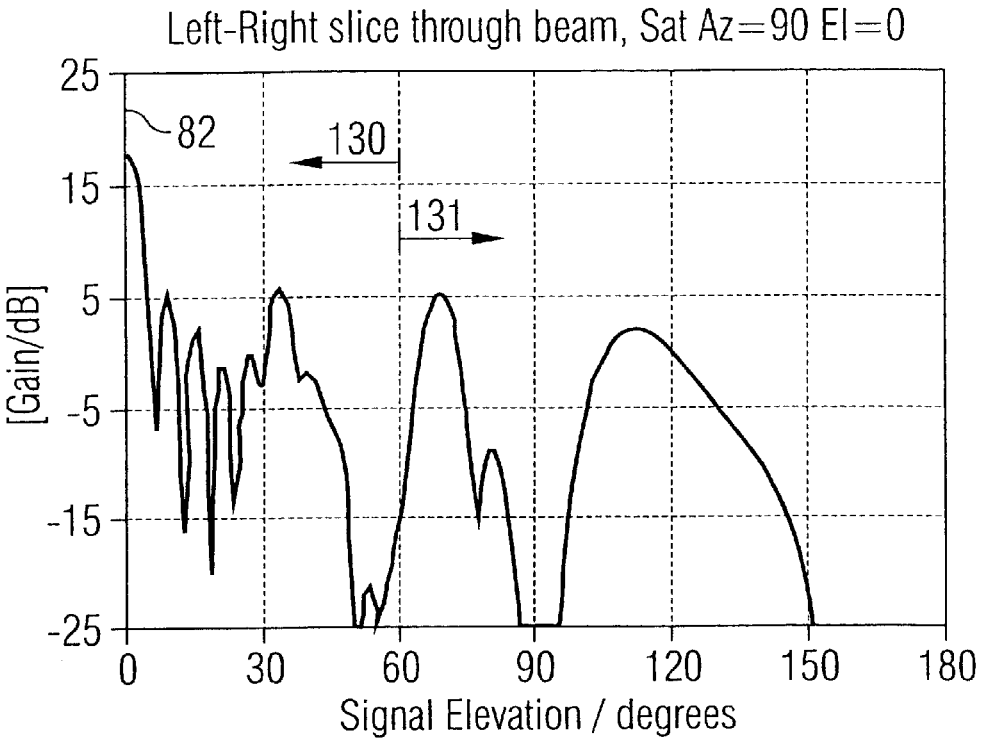

FIG. 8B shows the antenna gain in dB (in transmit or receive mode) in a slice in the plane of the arc beginning in the direction 82 (El=0°), through a full semicircle (to El=180°). As discussed above, only the tiles 120 within the 60° arc from direction 82 will participate in reception/transmission of the signals, and their gain is shown in section 130 of the gain response. The remainder 131 of the gain response is unused, corresponding to disabled tiles 121. A high response is shown in the direction 82, rapidly decreasing with increasing elevation.

Figure 8C:
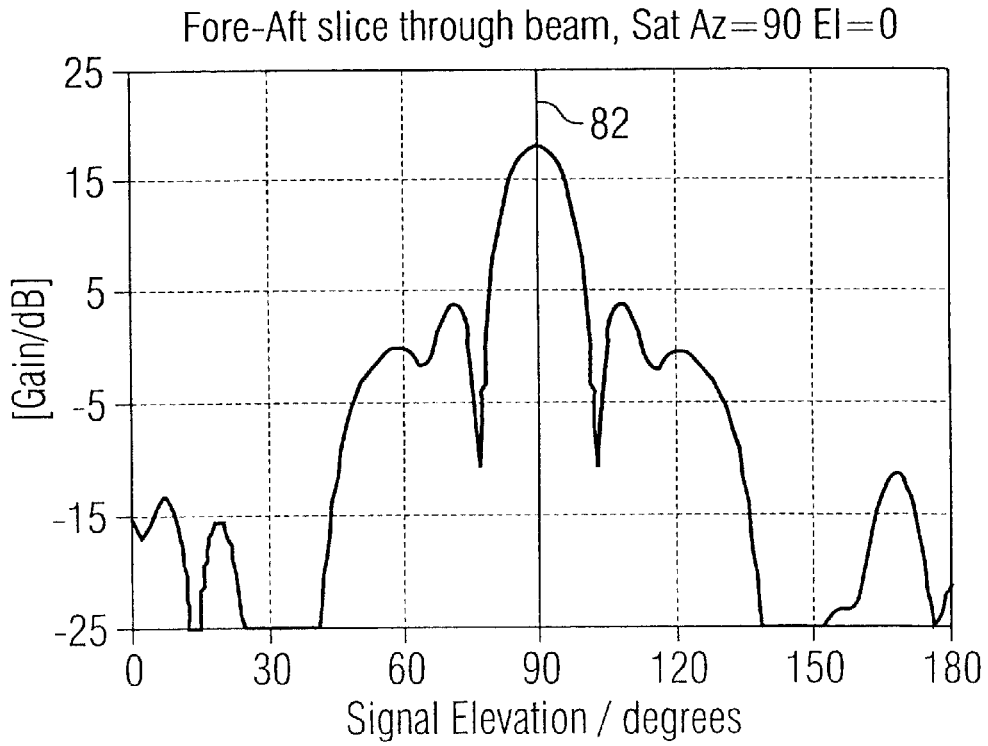

FIG. 8C shows the antenna gain in dB (in transmit or receive mode) in a vertical slice (El=90°) in a plane through the axis. The response is substantially symmetrical, showing a high response in the direction 82, rapidly dropping off to the side.

Figure 9A:
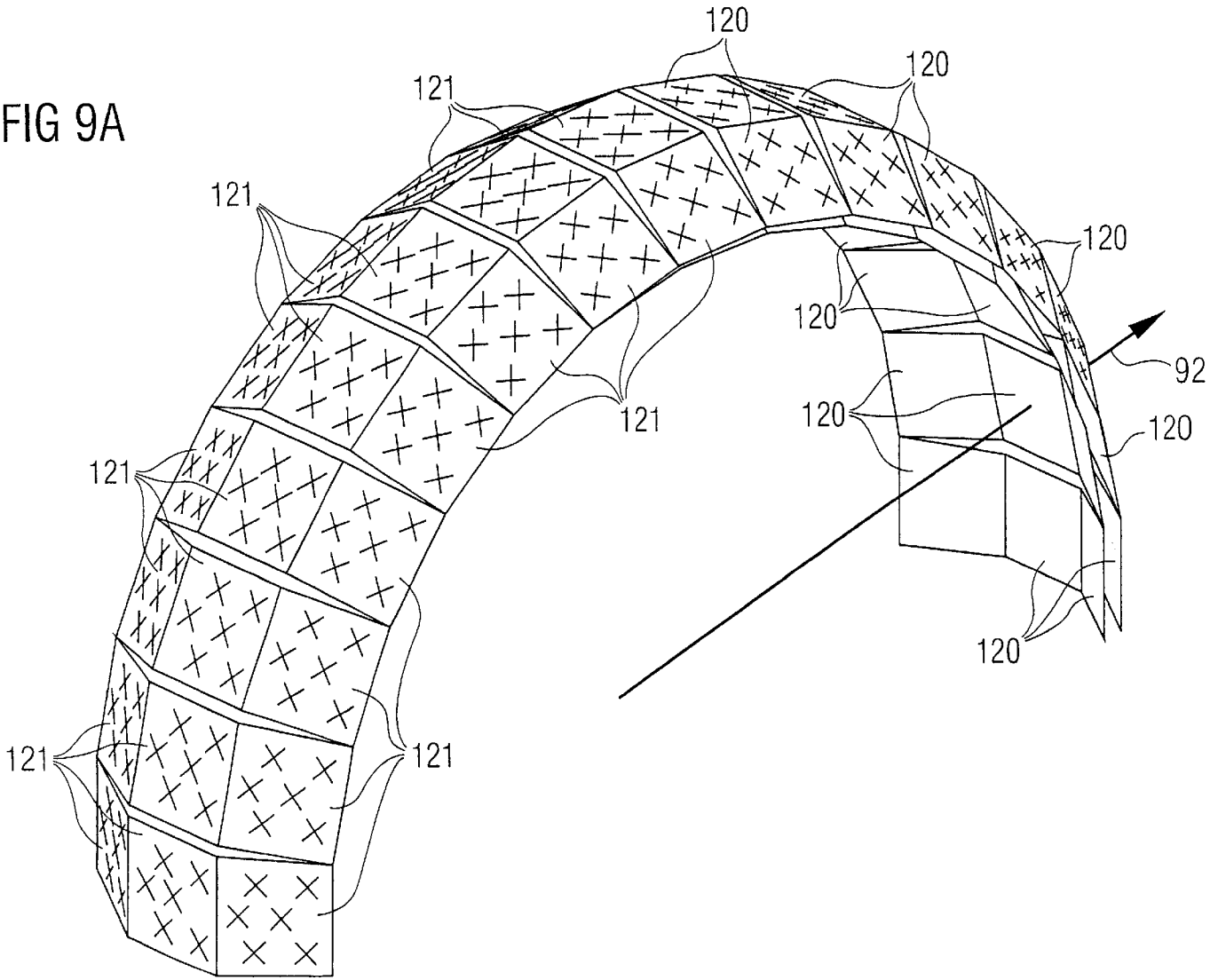

FIG. 9A shows a figure similar to that of FIG. 8A, but here the antenna A receives and/or transmits a signal from/to the direction 92. This direction corresponds to Az (azimuth)=90°; El (elevation)=18°. All of the antenna tiles 20 which are capable of transmitting/receiving in the direction 92 are enabled, and are individually tuned, according to known phased array antenna beam steering methods, to be active in the direction 92. Typically, a planar phased array antenna may have its transmission and/or reception sensitivity "beam-steered" in any direction of up to 60° from the normal. In the example shown in FIG. 9A, all tiles within an arc corresponding to an elevation angle of EL=−42° to 78° are enabled and appropriately beam-steered. These tiles are labelled 120 in FIG. 9A. Since the entire arc encompasses approximately 180°, approximately 43% (78/180) of the tiles are used in FIG. 9A. The remaining tiles 121 are inactive. They are prevented from transmitting or receiving signals, because any signals they could receive will be noise, not from the intended source, and any signals they could transmit would not reach their intended destination.

Figure 9B:
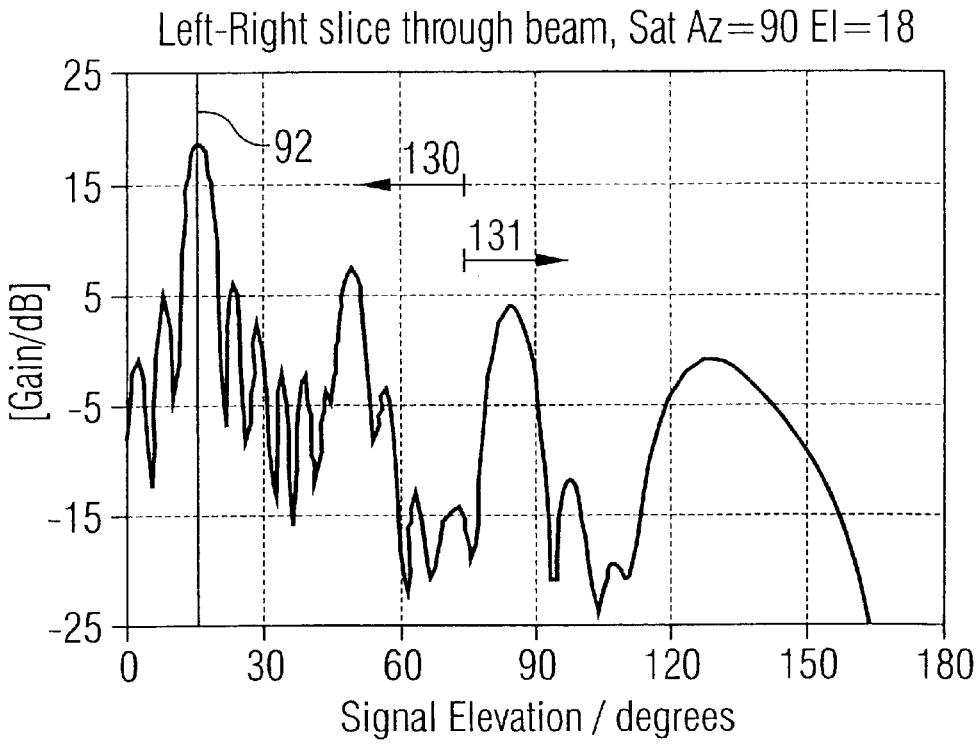

FIG. 9B shows the antenna gain in dB (in transmit or receive mode) in a slice in the plane of the arc beginning in the direction El=0°, through a full semicircle to El=180°. As discussed above, only the tiles 120 within the +/−60° arc from direction 92 will participate in reception, transmission of the signals, and their gain is shown in section 130 of the gain response. The remainder 131 of the gain response is unused, corresponding to disabled tiles 121. A high response is shown in the direction 92, rapidly decreasing with divergent values of elevation.

Figure 9C:
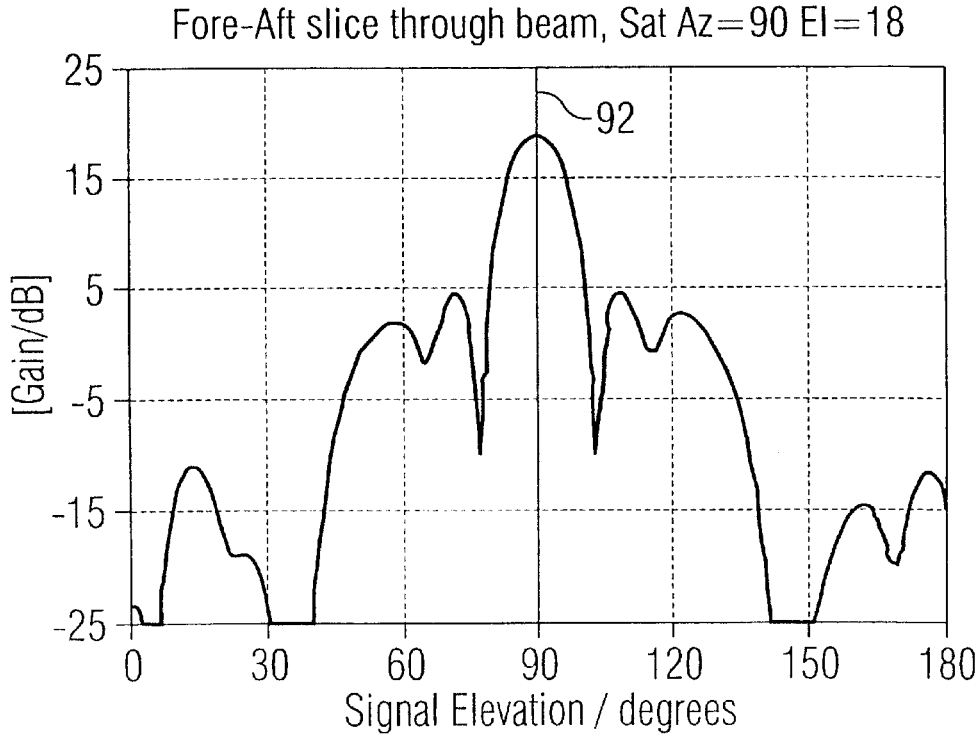

FIG. 9C shows the antenna gain in dB (in transmit or receive mode) in a vertical slice (El=90°) in a plane through the axis. The response is substantially symmetrical, showing a high response in the direction 92, rapidly dropping off either side.

Figure 10A:
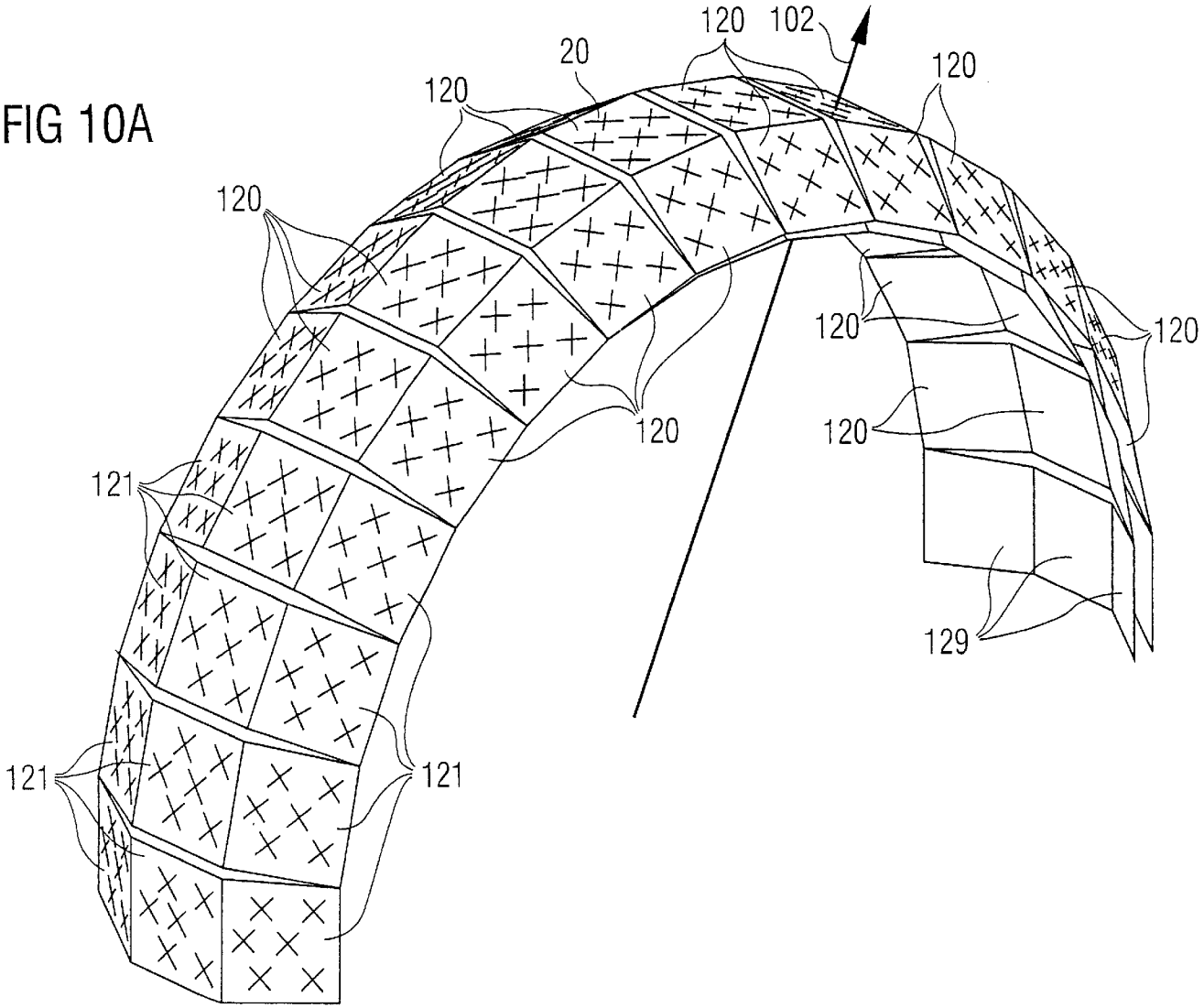

FIG. 10A shows a figure similar to that of FIG. 8A, but here the antenna A receives and/or transmits a signal from/to the direction 102. This direction corresponds to Az (azimuth)=90°; El (elevation)=66°. All of the antenna tiles 20 which are capable of transmitting/receiving in the direction 102 are enabled, and are individually tuned, according to known phased array antenna beam steering methods, to be active in the direction 102. Typically, a planar phased array antenna may have its transmission and/or reception sensitivity "beam-steered" in any direction of up to 60° from the normal. In the example shown in FIG. 10A, all tiles within an arc corresponding to an elevation angle of EL=6° to 126° are enabled and appropriately beam-steered. These tiles are labelled 120 in FIG. 10A. Tiles such as 129 occupy peripheral positions, and although they lie outside the typical +/−60° range, may be included as they may provide some useful additional gain. Since the entire arc encompasses approximately 180°, approximately 67% (120/180) of the tiles are used in FIG. 10A. The remaining tiles 121 are inactive. They are prevented from transmitting or receiving signals, because any signals they could receive will be noise, not from the intended source, and any signals they could transmit would not reach their intended destination.

Figure 10B:
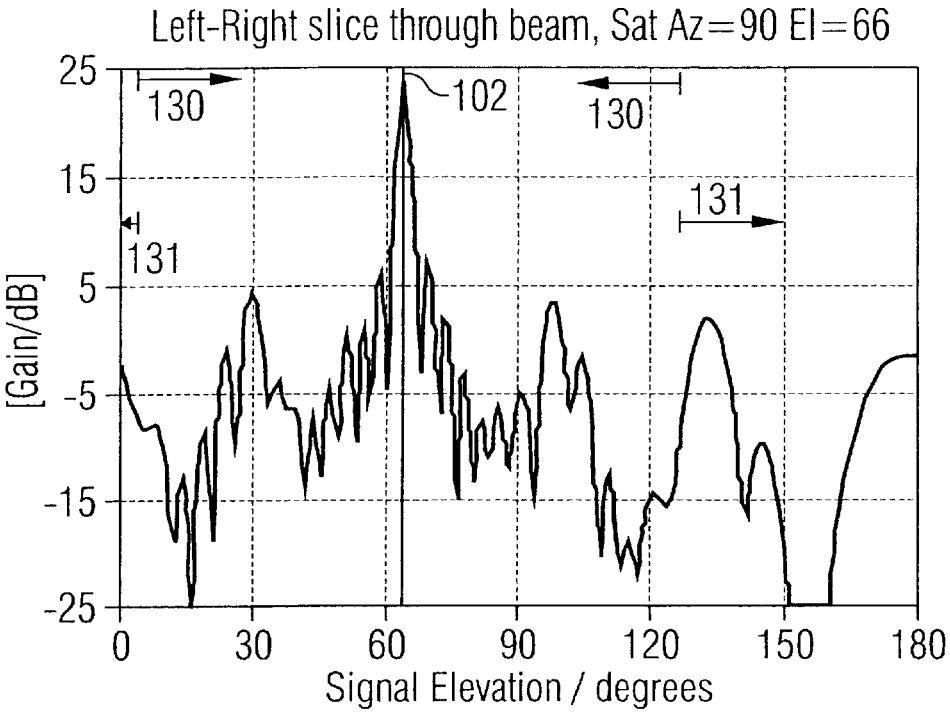

FIG. 10B shows the antenna gain in dB (in transmit or receive mode) in a slice in the plane of the arc beginning in the direction El=0°, through a full semicircle to El=180°. As discussed above, only the tiles 120 within the +/−60° arc from direction 102 will participate in reception, transmission of the signals, and their gain is shown in section 130 of the gain response. The remainder 131 of the gain response is unused, corresponding to disabled tiles 121. A high response is shown in the direction 102, rapidly decreasing with divergent values of elevation.

Figure 10C:
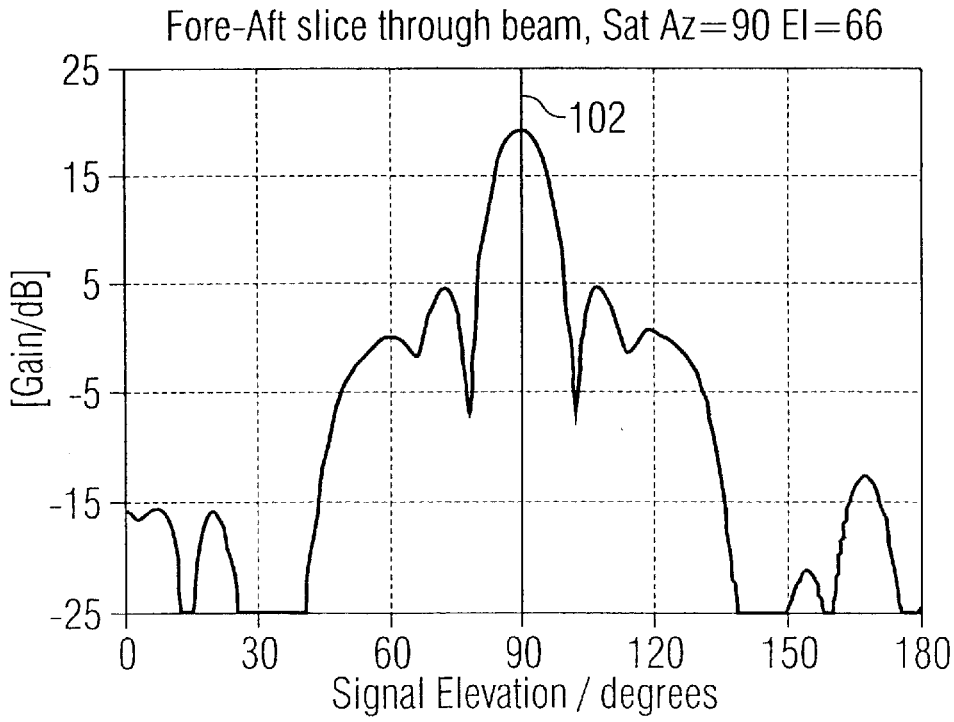

FIG. 10C shows the antenna gain in dB (in transmit or receive mode) in a vertical slice (El=90°) in a plane through the axis. The response is substantially symmetrical, showing a high response in the direction 102, rapidly dropping off either side.

Figure 11A:
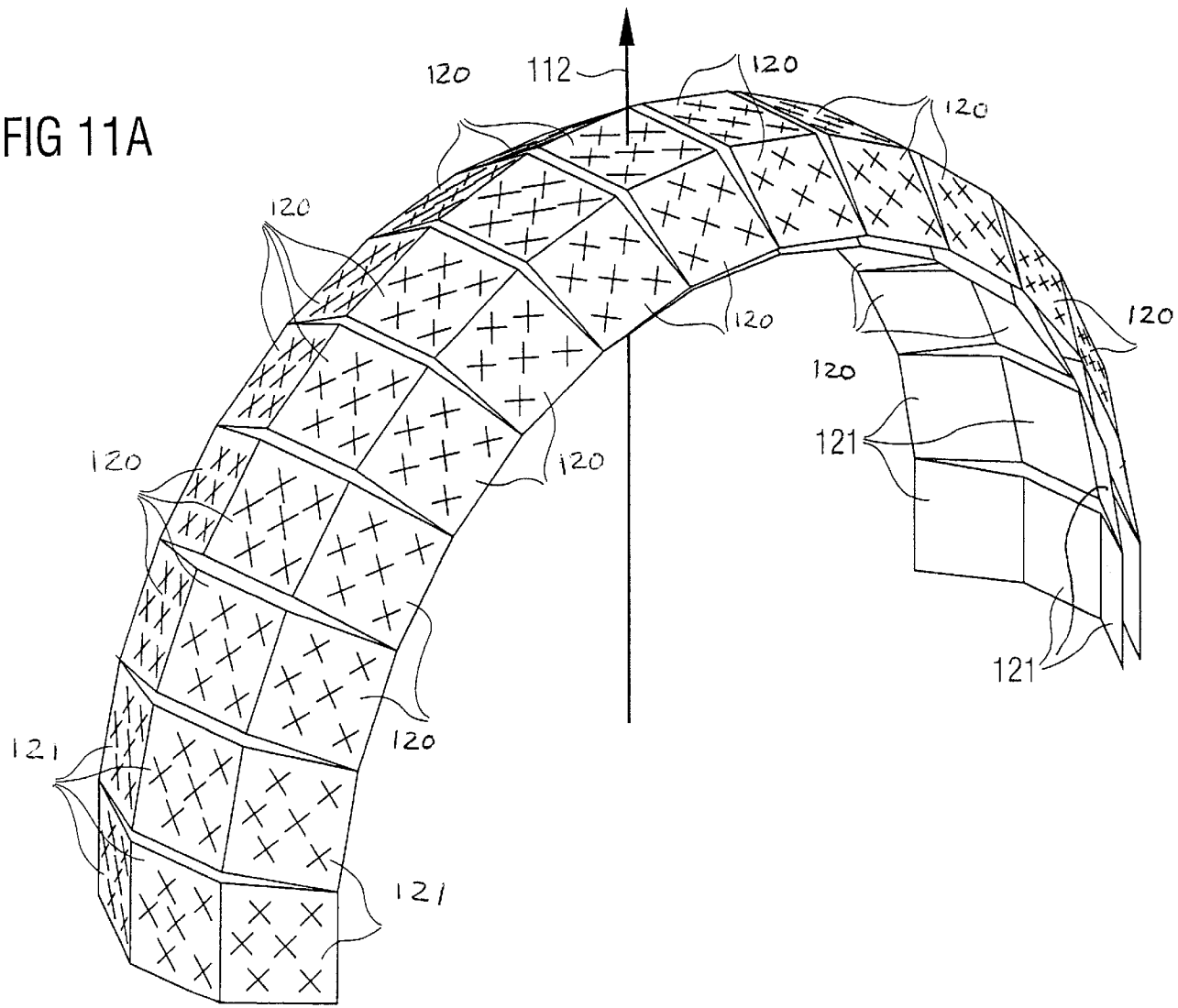

FIG. 11A shows a figure similar to that of FIG. 8A, but here the antenna A receives and/or transmits a signal from/to the direction 112. This direction corresponds to Az (azimuth)=90°; El (elevation)=90°. All of the antenna tiles 20 which are capable of transmitting/receiving in the direction 112 are enabled, and are individually tuned, according to known phased array antenna beam steering methods, to be active in the direction 112. Typically, a planar phased array antenna may have its transmission and/or reception sensitivity "beam-steered" in any direction of up to 60° from the normal. In the example shown in FIG. 11A, all tiles within an arc corresponding to an elevation angle of EL=30° to 150° are enabled and appropriately beam-steered. These tiles are labelled 120 in FIG. 11A. Since the entire arc encompasses approximately 180°, approximately 67% (120/180) of the tiles are used in FIG. 11A. The remaining tiles 121 are inactive. They are prevented from transmitting or receiving signals, because any signals they could receive will be noise, not from the intended source, and any signals they could transmit would not reach their intended destination.

Figure 11B:
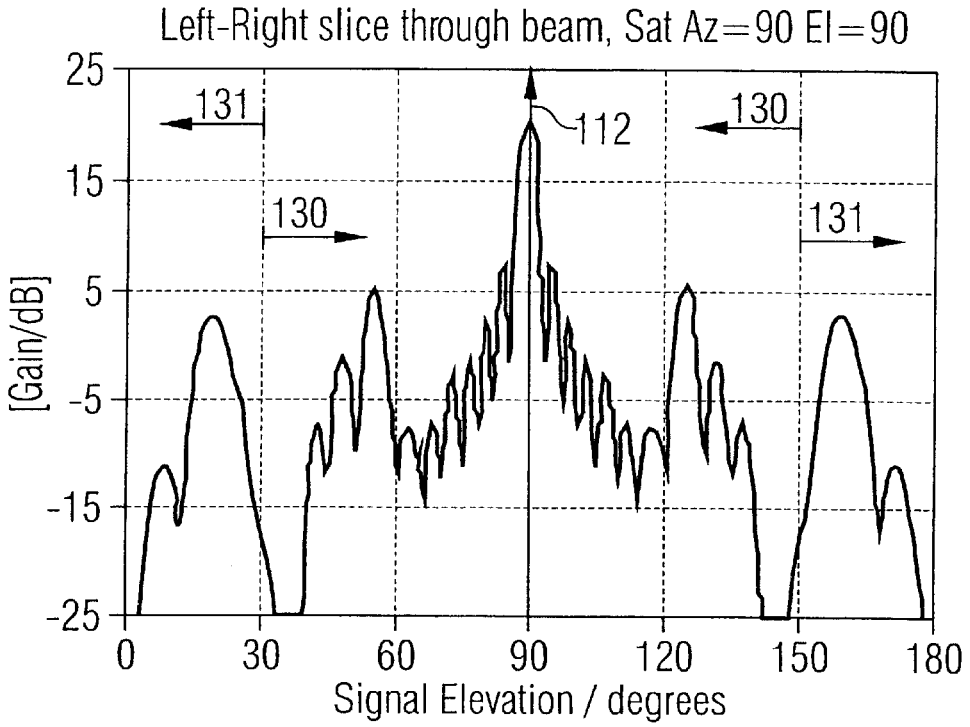

FIG. 11B shows the antenna gain in dB (in transmit or receive mode) in a slice in the plane of the arc beginning in the direction El=0°, through a full semicircle to El=180°. As discussed above, only the tiles 120 within the +/−60° arc from direction 112 will participate in reception, transmission of the signals, and their gain is shown in section 130 of the gain response. The remainder 131 of the gain response is unused, corresponding to disabled tiles 121. A high response is shown in the direction 112, rapidly decreasing with divergent values of elevation.

Figure 11C:
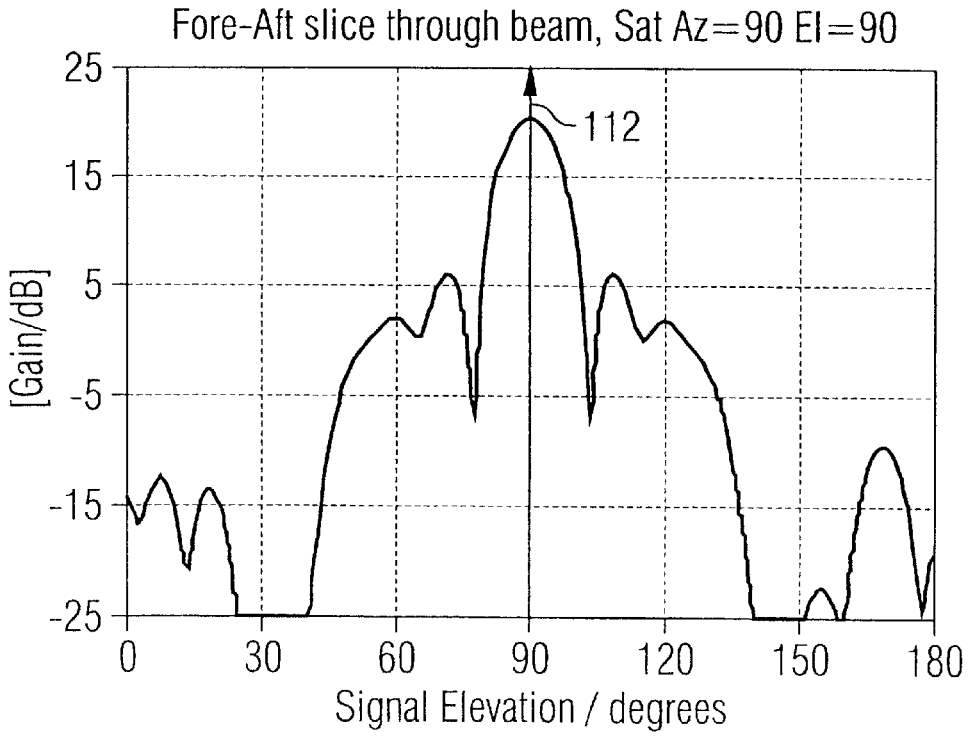

FIG. 11C shows the antenna gain in dB (in transmit or receive mode) in a vertical slice (El=90°) in a plane through the axis. The response is substantially symmetrical, showing a high response in the direction 112, rapidly dropping off either side.

Figure 12A:
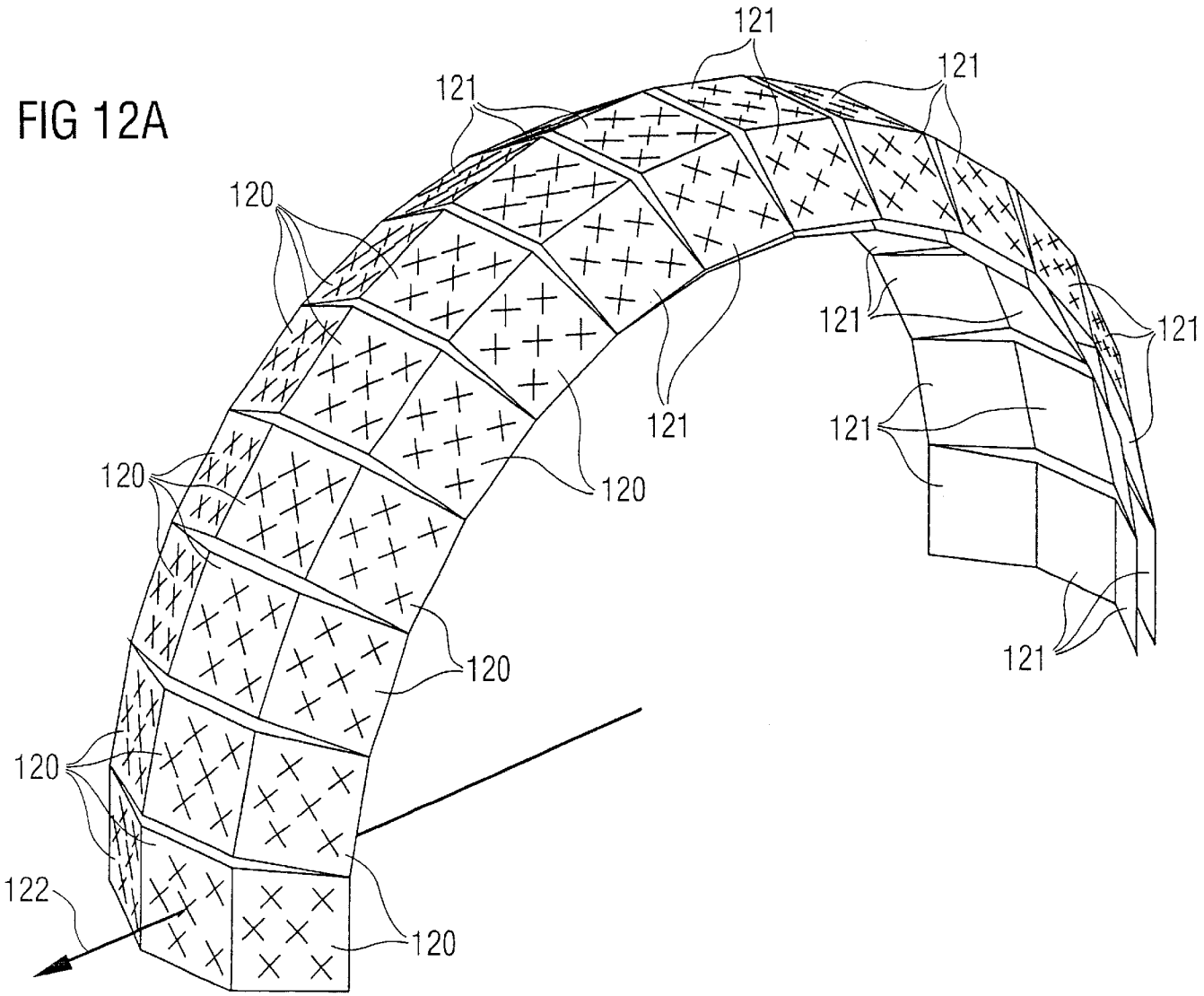

FIG. 12A shows a figure similar to that of FIG. 8A, but here the antenna A receives and/or transmits a signal from/to the direction 122. This direction corresponds to Az (azimuth)=90°; El (elevation)=180°. All of the antenna tiles 20 which are capable of transmitting/receiving in the direction 122 are enabled, and are individually tuned, according to known phased array antenna beam steering methods, to be active in the direction 122. Typically, a planar phased array antenna may have its transmission and/or reception sensitivity "beam-steered" in any direction of up to 60° from the normal. In the example shown in FIG. 12A, all tiles within an arc corresponding to an elevation angle of EL=120° to 180° are enabled and appropriately beam-steered. These tiles are labelled 120 in FIG. 12A. Since the entire arc encompasses approximately 180°, approximately 33% (60/180) of the tiles are used in FIG. 12A. The remaining tiles 121 are inactive. They are prevented from transmitting or receiving signals, because any signals they could receive will be noise, not from the intended source; and any signals they could transmit would not reach their intended destination.

Figure 12B:
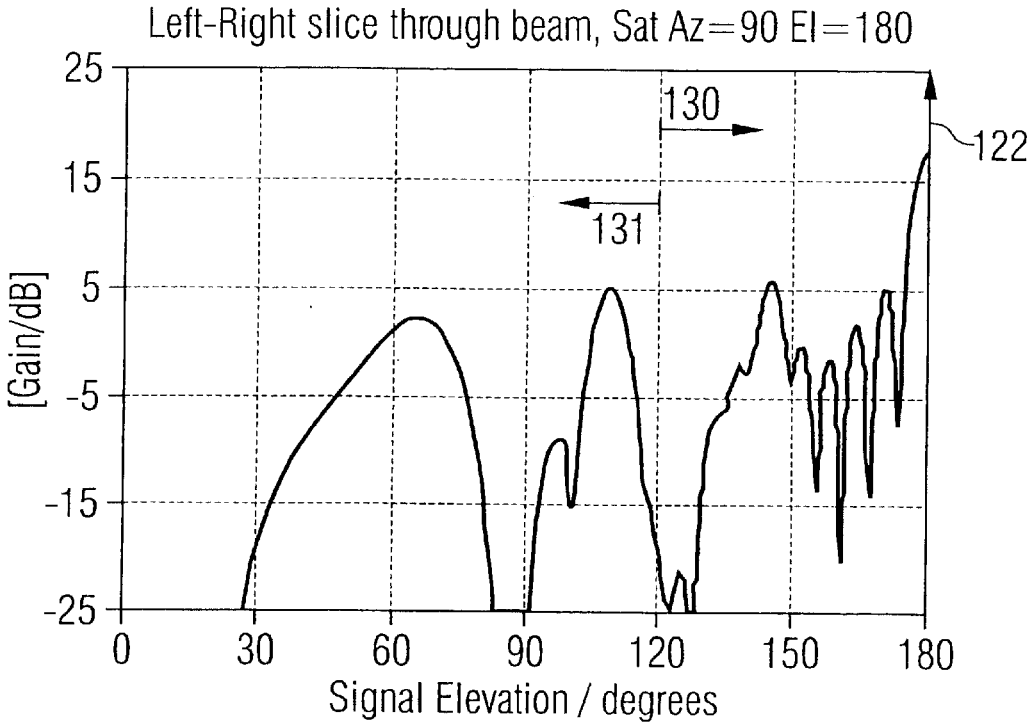

FIG. 12B shows the antenna gain in dB (in transmit or receive mode) in a slice in the plane of the arc beginning in the direction El=0°, through a full semicircle to El=180°. As discussed above, only the tiles 120 within the +/−60° arc from direction 122 will participate in reception/transmission of the signals, and their gain is shown in section 130 of the gain response. The remainder 131 of the gain response is unused, corresponding to disabled tiles 121. A high response is shown in the direction 122, rapidly decreasing with divergent values of elevation.

Figure 12C:
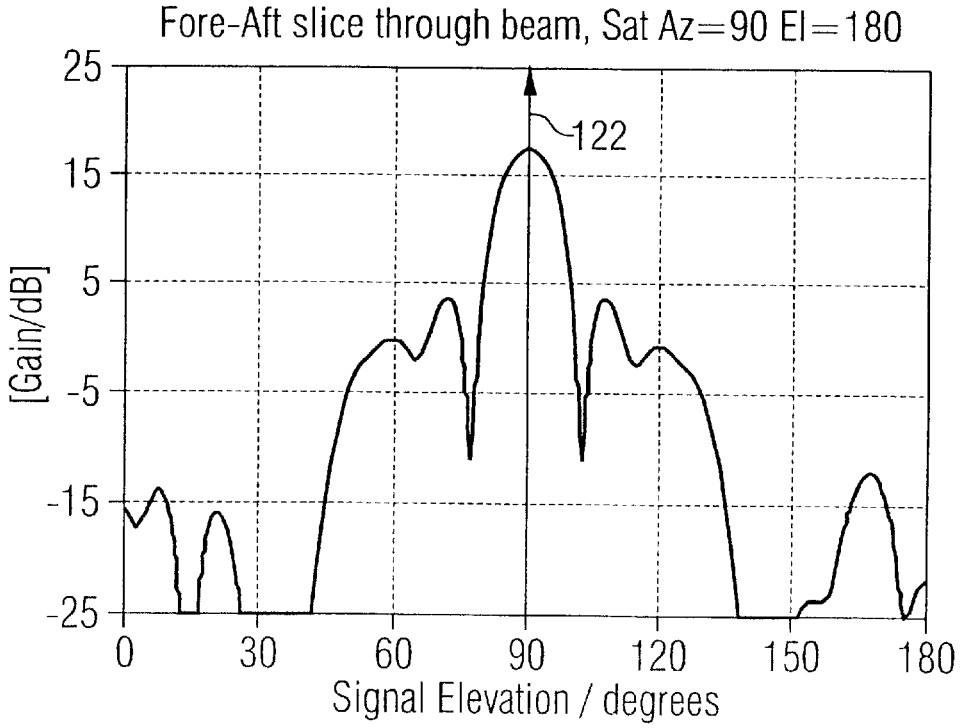

FIG. 12C shows the antenna gain in dB (in transmit or receive mode) in a vertical slice (El=90°) in a plane through the axis. The response is substantially symmetrical, showing a high response in the direction 122, rapidly dropping off either side.

Figure 13A:
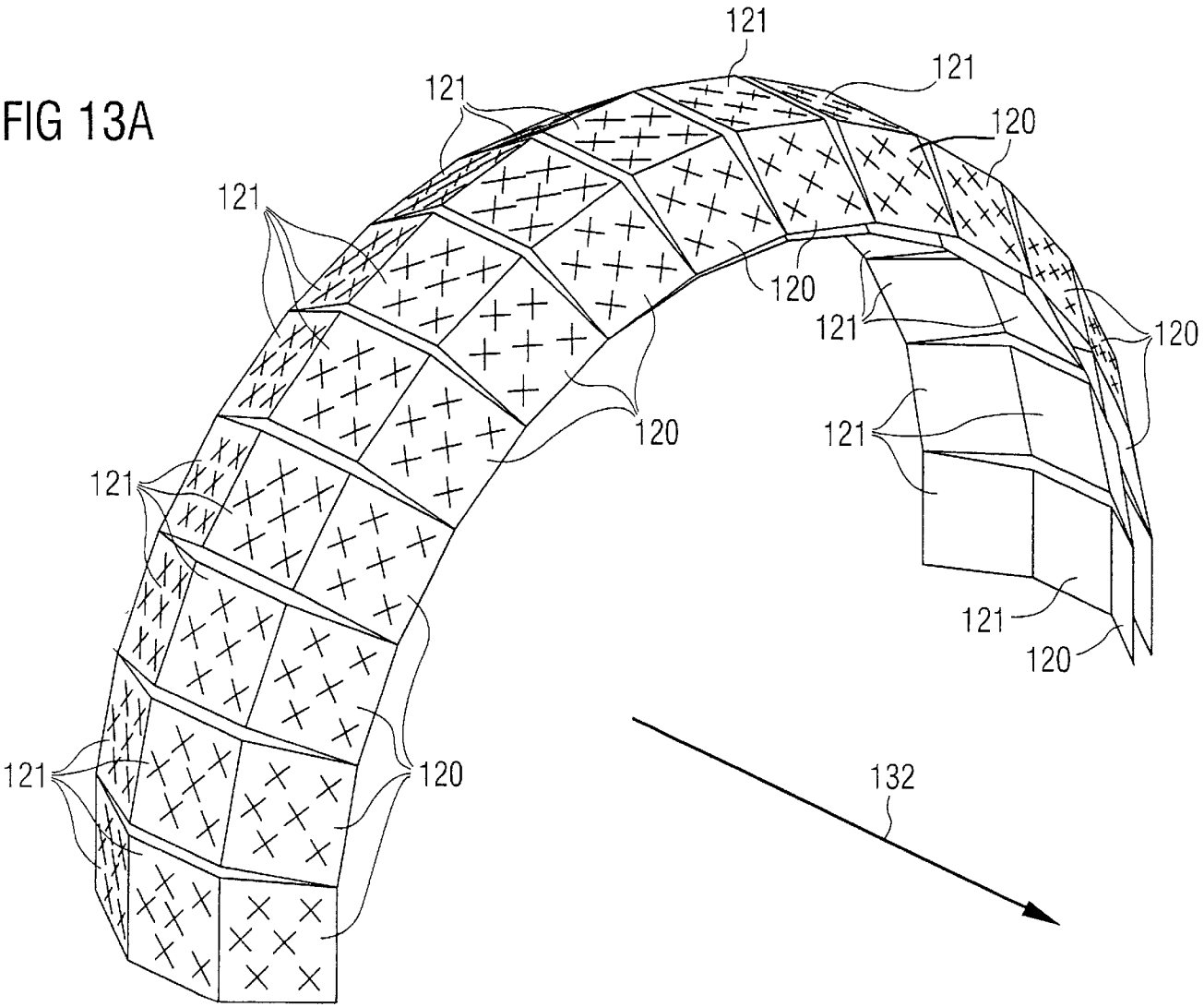

FIG. 13A shows a figure similar to that of FIG. 8A, but here the antenna A receives and/or transmits a signal from/to the direction 132. This direction corresponds to Az (azimuth)=0°; El (elevation)=180°. All of the antenna tiles 20 which are capable of transmitting/receiving in the direction 132 are enabled, and are individually tuned, according to known phased array antenna beam steering methods, to be active in the direction 132. Typically, a planar phased array antenna may have its transmission and/or reception sensitivity "beam-steered" in any direction of up to 60° from the normal. In the example shown in FIG. 13A, all tiles within the arc 11 facing in the direction 132 are enabled and appropriately beam-steered. These tiles are labelled 120 in FIG. 13A. Since the entire arc encompasses three arcs of tiles, approximately one third of the tiles are used in FIG. 13A. The remaining tiles 121 are inactive. They are prevented from transmitting or receiving signals, because any signals they could receive will be noise, not from the intended source, and any signals they could transmit would not reach their intended destination. The direction 132 shown corresponds to the exact forward or aft direction of an aircraft or similar upon which this antenna array may be mounted. It is at the extreme operating limit of the antenna, being at the maximum permissible angle of 60° to all the enabled tiles 120.

Figure 13B:
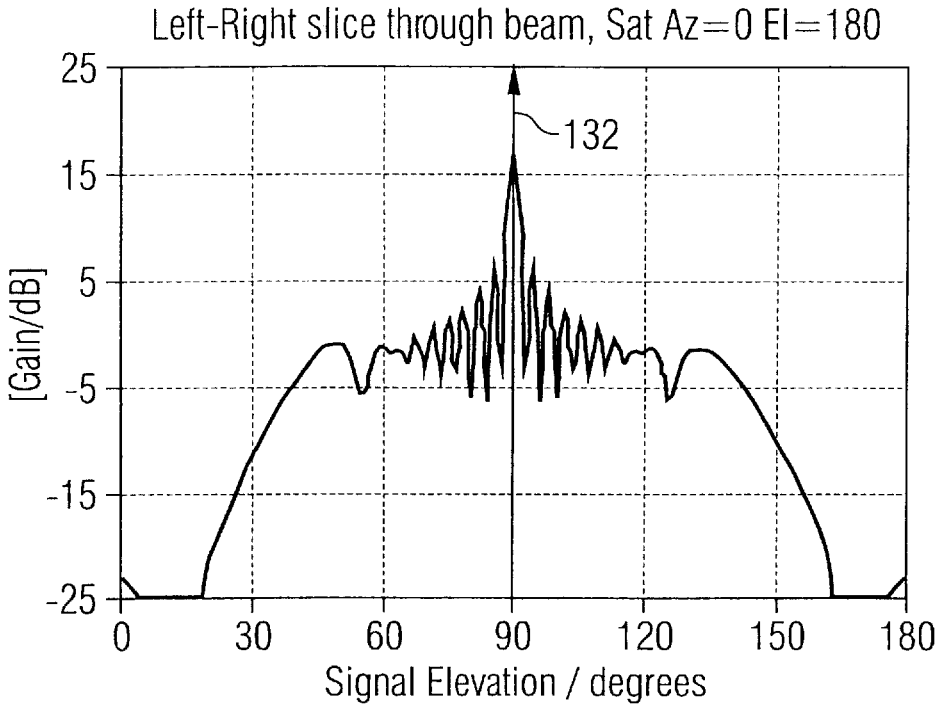

FIG. 13B shows the antenna gain in dB (in transmit or receive mode) in a slice in a plane perpendicular to the plane of the arc beginning in the direction El=0°, through a full semicircle to El=180°. As discussed above, only the tiles 120 within +/−60° from direction 132 will participate in reception/transmission of signals. As shown in FIG. 13B, the antenna response in the beam steer direction is approximately constant over a relatively wide range of elevation, around 60–120°. The beam steer direction, at 90°, provides a gain 10 dB higher than the gain in neighbouring regions. While this is not a particularly large gain differential, it is sufficient to provide useful discrimination of signals from the steered direction 132.

Figure 13C:
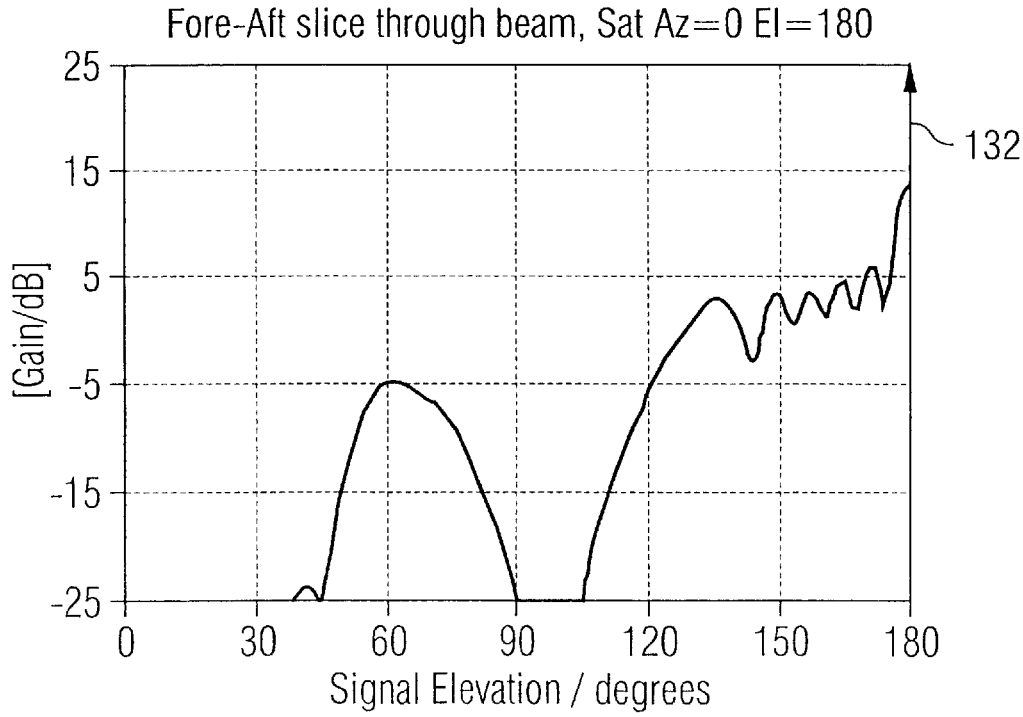

FIG. 13C shows the antenna gain in dB (in transmit or receive mode) in a vertical slice in a plane through the axis. The response shows a high response in the direction 132, rapidly dropping off at lower values of elevation.

The present invention accordingly provides a conformal phased array antenna, whose sensitivity may be directed over a very wide range of angles of azimuth and elevation, which is relatively inexpensive to construct being composed of a number of preferably identical tiles each constructed by a relatively inexpensive method such as printed circuit board assembly techniques. The tiles are assembled into an array which may be adapted to conform to a contour of a vehicle which will carry the antenna. The antenna may comprise tiles arranged about an axis, parallel to the axis, and tilted by at least +/−30° to the axis. This will enable transmission and reception along the axis in both directions, and in a direction perpendicular to the axis, each of the tiles having a steering range, possibly of some +/−60°, which will further increase the angular coverage of the antenna. By providing a semicircular arc arrangement of tiles each oriented parallel to the axis, accompanied by a further semicircular arc of tiles each tilted by at least −30° to the axis and by a further semicircular arc of tiles each tilted by at least +30° to the axis, the antenna may be capable of being directed over a full hemisphere. Such arrangement may be suitable for mounting on an aircraft, and may be adapted to conform to the contours of the aircraft, since the respective arcs need not, in fact, be parts of a circle, but may simply follow loci of a contour of the vehicle which will carry the antenna.

By tilting each of the outer tiles at 30° to the adjacent tile of the central arc, the profile of the resultant antenna may be kept as low as possible, reducing aerodynamic drag when carried on an aircraft or other high-speed vehicle. Such an angle of tilt also allows all of the tilted tiles to be sensitive in the forward or aft directions. Any higher value of tilt would increase the profile, and the air resistance. Any lower value of tilt would reduce the ability of the antenna array to transmit or receive in the forward and aft directions.

Considering again the embodiment shown in FIG. 1, There is ample space in the region under the array, between the array and the fuselage in FIGS. 6–7, to house the necessary power supplies, distribution networks and control circuitry.

In operation, the antenna is required to transmit or receive signals in a particular direction. These directions may be conveniently referred to as azimuth and elevation, taking the antenna as a reference. For the examples shown in FIGS. 1, 8A–13A the required three reference dimensions may be defined according to the plane containing the axis of the arc, and bisecting the arc, the plane of the arc, and the plane containing the axis and at right angles to the two other planes. By determining the direction of the signal in azimuth and elevation, a control circuit, not shown in the drawings, may calculate which of the tiles 120 are capable of transmitting or receiving in that direction (being any tile whose normal lies within a predetermined limit, typically 60°, of the required direction). All of these are enabled, and connected to participate in the transmission or reception. Each enabled tile 120 is individually phase steered to be active in the required direction. The remaining tiles 121 are not enabled. This maximises the attainable signal-to-noise ratio by eliminating noise that would otherwise be produced by tiles not contributing to the signal. The level of sidelobes is also reduced by only enabling the useful tiles, reducing sensitivity of the antenna in directions other than the required direction.

Certain examples of the construction of the tiles 20 will now be discussed.

Figure 14:
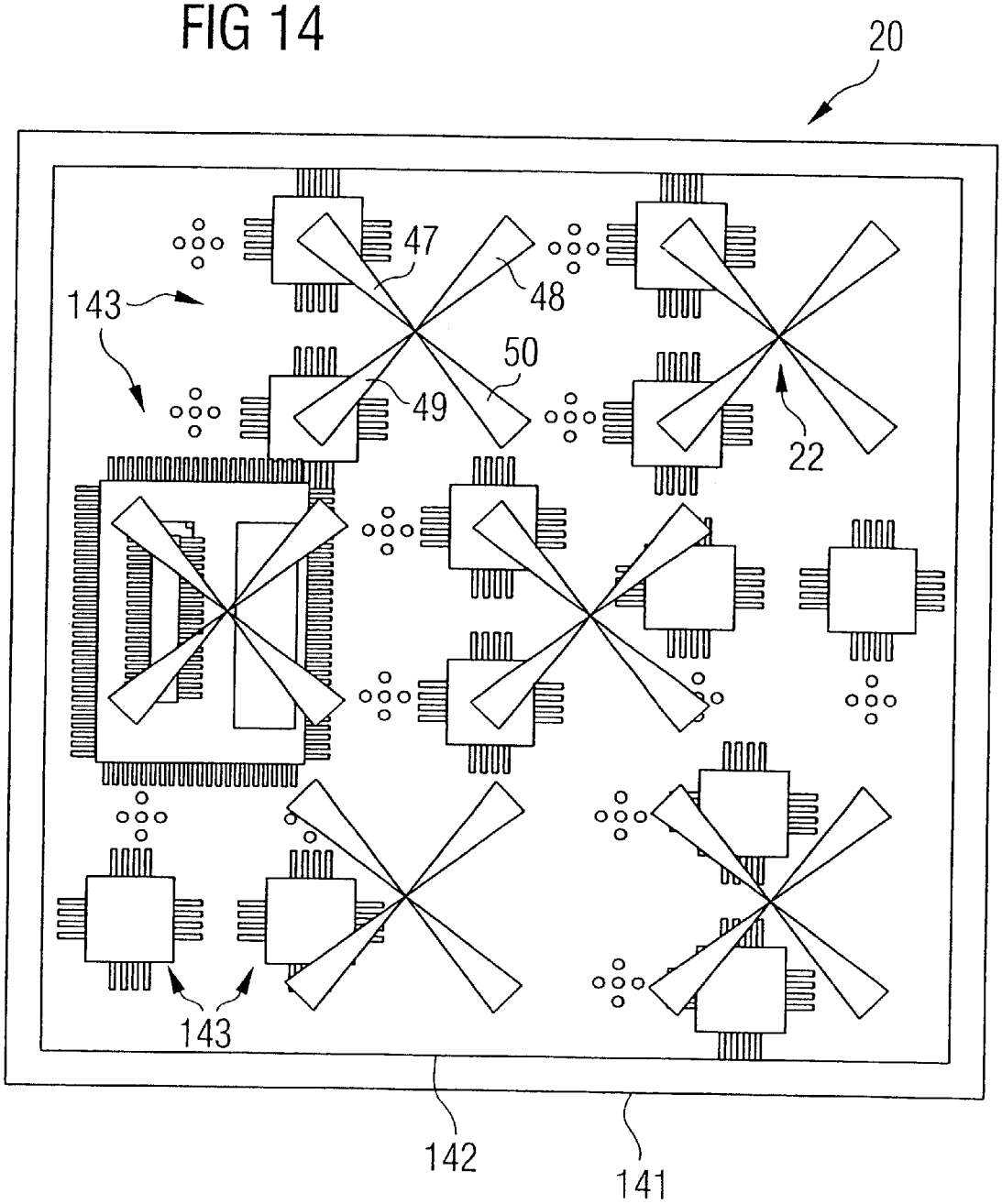
FIG. 14 shows a possible layout of circuit boards for a tile for an antenna assembly according to the present invention.

FIG. 14 shows an embodiment of a tile which could be used as a tile an antenna according to the present invention. The tile may comprise at least two printed circuit boards sandwiched together. An upper printed circuit board 141 may have an outer foil layer comprising the antenna elements 47, 48, 49, 50. Six sets 22 of such antenna elements are shown on the tile of FIG. 14. A ground plane 151 (not shown in FIG. 14) should preferably be located behind the antenna elements, most preferably at a distance of one quarter-wavelength of the signals of interest ($\lambda/4$). Depending on the wavelength $\lambda$ of the signals of interest, this distance may be provided within the thickness of the printed circuit board upon which the antenna elements are formed, in which case the ground plane may form a rear, or inner, conductive layer of the upper printed circuit board. Alternatively, the ground plane may be an upper conductive layer on a second printed circuit board, mechanically retained at the appropriate distance behind the antenna elements. Control circuitry 143 required to operate the tile, such as distribution and combining network, beam steering phase shifters and transmit and receive amplifiers may be placed on a further printed circuit board, mechanically separated from the board containing the antenna elements. Electrical connection will of course need to be made between the control circuitry and the antenna elements. This may preferably be achieved using sprung mechanical contacts 152 (not shown in FIG. 14) or the like, to enable the boards to be readily separated for maintenance, repair or replacement.

Figure 15:
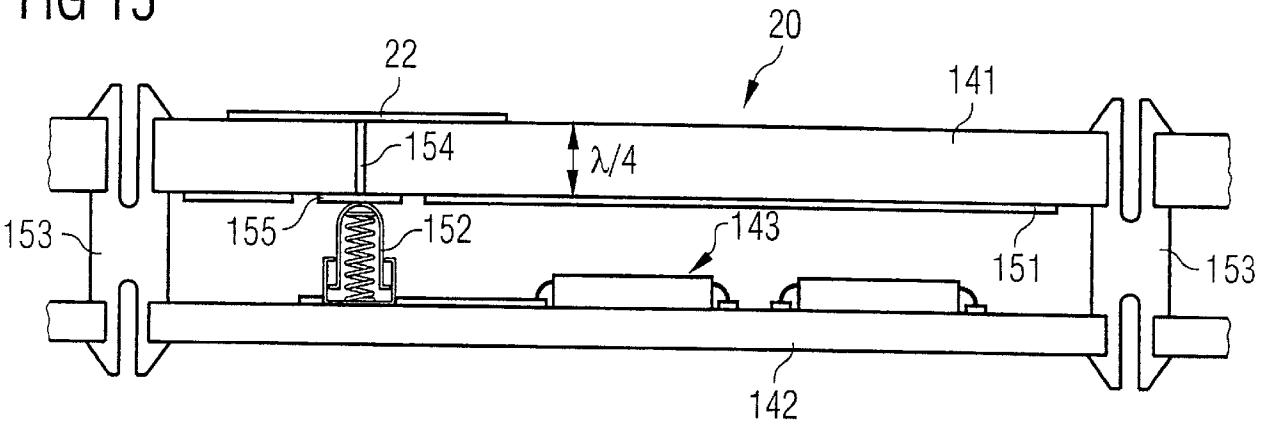
FIGS. 15–17 show alternative embodiments of a tile for an antenna assembly according to the present invention.
Figure 16:
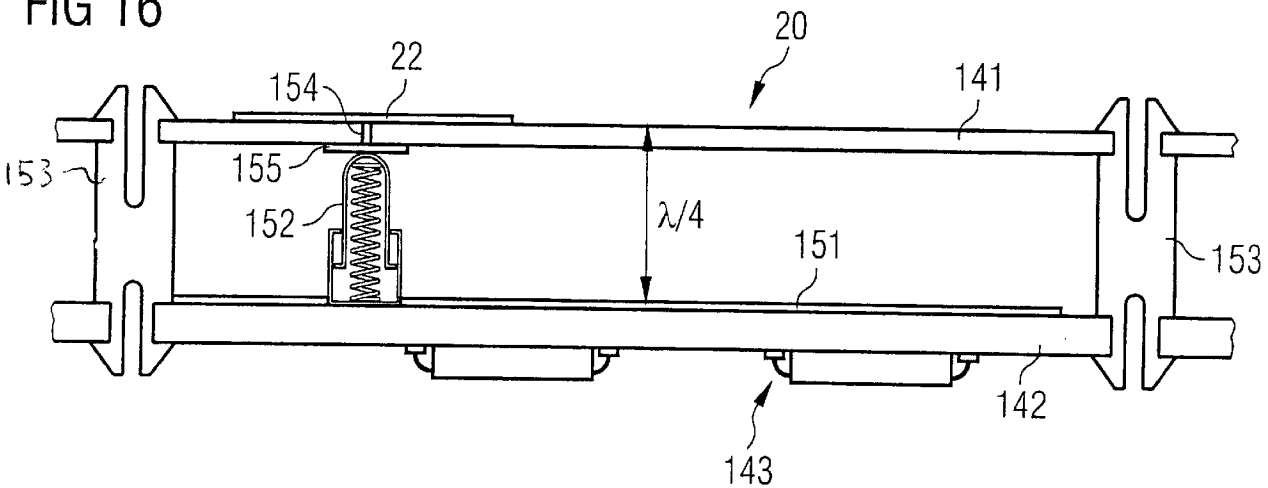
Figure 17:
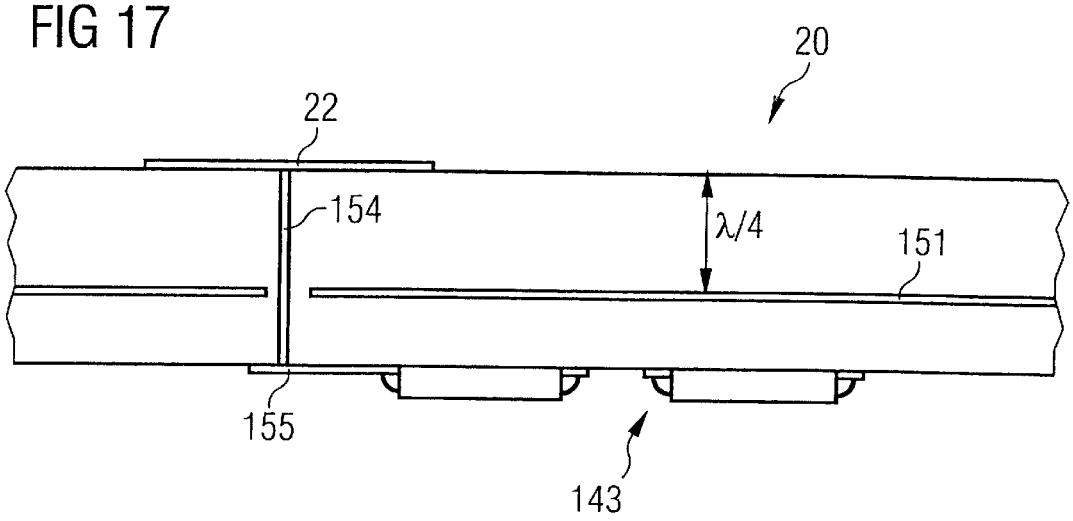

FIGS. 15–17 show cross sections of some possible embodiments of the tiles used in the antenna of the present invention.

In FIG. 15, the upper circuit board 141 has an upper conductive layer formed into the sets of antenna segments 22. It also has a lower conductive layer forming ground plane 151. The thickness of the board 141 is chosen such that the ground plane is separated from the antenna elements by a distance which is most preferably equal to one quarter-wavelength of the signals of interest ($\lambda/4$). A lower circuit board 142 is separated from, and attached to, upper circuit board 141 by mechanical spacers 153 which may, for example, be formed of a moulded plastic material. Lower circuit board 142 carries the control circuitry 143, for example on an upper surface. The control circuitry is connected to the antenna elements, for example by way of spring loaded contacts 152, through-conductors 154 and conductive pads 155 on the lower surface of upper circuit board 141.

In FIG. 16, the upper circuit board 141 has an upper conductive layer formed into the sets of antenna segments 22. Lower circuit board 142 is separated from, and attached to, upper circuit board 141 by mechanical spacers 153 which may, for example, be formed of a moulded plastic material. It has an upper conductive layer forming ground plane 151. The length of the spacers 153 is chosen such that the ground plane is separated from the antenna elements by a distance which is most preferably equal to one quarter-wavelength of the signals of interest ($\lambda/4$). Lower circuit board 142 carries the control circuitry 143, on a lower surface. The control circuitry is connected to the antenna elements, for example by way of spring loaded contacts 152, through-conductors 154 and conductive pads 155 on the lower surface of upper circuit board 141.

In FIG. 17, the functions of upper and lower circuit board are combined. This may be by using a multilayer circuit board, or by assembling two separate board together using some filler material, such as an epoxy resin. The upper surface of the tile 20 has a conductive layer formed into the sets of antenna segments 22. Ground plane 151 is located within the tile 20, separated from the antenna elements by a distance which is most preferably equal to one quarter-wavelength of the signals of interest ($\lambda/4$). A lower conductive layer carries the control circuitry 143. The control circuitry is connected to the antenna elements, for example by way of through-conductors 154 and conductive pads 155 on the lower surface.

While certain specific embodiments of the present invention have been described, many modifications and variations are possible, without departing from the scope of the present invention. For example, the various tiles are preferably identical for economy of manufacture and ease of assembly and repair, but they need not be. The antenna of the present invention may be formed into any shape which conforms to a contour of an underlying support structure. Certain tiles of the antenna are preferably angled with respect to other tiles, but they need not be. While the described antenna seeks to provide forward and aft sensitivity with minimal profile in such directions, that is not a requirement of the invention. If a particular application does not require sensitivity in those directions, the size and orientation of tiles may be adjusted as appropriate to fulfill other design criteria, such as to improve aerodynamics or aesthetic considerations.

With regard to the specific embodiments described, the tiles of the central arc need not be in planes parallel to the central axis, but may be located in other planes tangent to the arc.

What is claimed is:

1. An antenna assembly comprising:

a plurality of first planar tiles, each of the first tiles carrying a planar array of sets of antenna elements arranged to be operated as a phased array antenna, the first tiles being arranged in an orientation which conforms substantially to a contour of an underlying structure, with the first tiles disposed along a first arc about an axis, each first tile lying in a plane that is tangent to the first arc; and a plurality of second tiles, each of said second tiles carrying a planar array of sets of antenna elements, being disposed along a second arc about said axis, and being tilted towards said axis relative to an adjacent first tile.

2. The antenna assembly of claim 1, wherein the underlying structure is a part of the fuselage of an aircraft.

3. The antenna assembly of claim 1, wherein the underlying structure is a part of a superstructure of an aircraft.

4. The antenna assembly of claim 1, wherein the underlying structure is a part of a land vehicle or a water-borne vehicle.

5. An antenna assembly comprising a plurality of planar tiles, each carrying a planar array of sets of antenna elements arranged to be operated as a phased array antenna; wherein:

the tiles are arranged in an orientation which is conformal to a contour of an underlying structure; and the underlying structure is a part of a vehicle carrying the antenna structure.

6. The antenna assembly of claim 5 wherein the underlying structure is a part of the fuselage of an aircraft.

7. The antenna assembly of claim 5 wherein the underlying structure is a part of a superstructure of an aircraft.

8. The antenna assembly of claim 5 wherein the underlying structure is a part of a land vehicle or a water-borne vehicle.

9. An antenna assembly according to claim 5, wherein the tiles are arranged in a first arc about an axis, the tiles each being arranged in a plane tangent to the arc.

10. An antenna according to claim 9 wherein the planes of the tiles are parallel to the axis.

11. An antenna assembly according to claim 9, further comprising a further arc of tiles about the axis, each tile of the further arc being tilted with respect to the adjacent tile of the first arc, towards the axis.

12. An antenna assembly according to claim 11, wherein the angle of the tilt is sufficient to enable the antenna array to be sensitive in the direction of the axis.

13. An antenna assembly according to claim 9, further comprising a further arc of tiles about the axis, on each side if the first arc of tiles, each tile of each further arc being tilted with respect to the adjacent tile of the first arc, towards the axis.

14. An antenna assembly according to claim 13, wherein the angle of the tilt is at least approximately 30°.

15. An antenna array according to claim 5, wherein each tile comprises control circuitry for controlling phase shifts in signals applied to, or received from, each set of antenna elements.

16. A method of communication, comprising the steps of:

providing an antenna assembly according to claim 5, calculating a direction of required transmission/reception with respect to the antenna assembly;

calculating which of the tiles are capable of transmitting or receiving in the required direction;

enabling the capable tiles and disabling the remaining tiles;

steering the antenna elements of the enabled tiles in the required direction; and using the enabled tiles of the antenna array for transmission and/or reception of required signals.

* * * * *